US006699135B2

(12) United States Patent
Cochron

(10) Patent No.: US 6,699,135 B2
(45) **Date of Patent: *Mar. 2, 2004**

(54) MULTIDIRECTIONAL AMUSEMENT DEVICE

(76) Inventor: Stat Cochron, 4925 Pine Hill Dr., Murray, UT (US) 84107

( * ) Notice: Subject to any disclaimer, the term of this patent is extended or adjusted under 35 U.S.C. 154(b) by 0 days.

This patent is subject to a terminal disclaimer.

(21) Appl. No.: 10/307,118

(22) Filed: Nov. 27, 2002

(65) Prior Publication Data

US 2003/0087706 A1 May 8, 2003

Related U.S. Application Data

(63) Continuation-in-part of application No. 10/007,599, filed on Nov. 13, 2001, now Pat. No. 6,511,381.
(60) Provisional application No. 60/247,301, filed on Nov. 10, 2000.

(51) Int. Cl.[7] ..... A63G 31/00
(52) U.S. Cl. ..... 472/49
(58) Field of Search ..... 472/49, 50, 131, 472/136, 137; 104/53, 69, 70

(56) References Cited

U.S. PATENT DOCUMENTS

| | | | | |
|---|---|---|---|---|
| 1,220,332 | A | 3/1917 | Happel | |
| 2,501,680 | A | 3/1950 | King | 285/97.3 |
| 3,661,279 | A | 5/1972 | Macrander | 214/15 R |
| 3,949,842 | A | 4/1976 | Kiehn | 188/189 |
| 4,017,198 | A | 4/1977 | Mason | 403/43 |
| 4,037,978 | A | 7/1977 | Connelly | 403/164 |
| 4,074,519 | A | 2/1978 | Garrett | 59/95 |
| 4,094,493 | A | 6/1978 | Polen | 254/144 |
| 4,308,419 | A | 12/1981 | Fredriksson | 174/185 |
| 4,416,366 | A | 11/1983 | Maryonovich et al. | 198/320 |
| 4,469,198 | A | 9/1984 | Crump | 187/8 |
| 4,500,056 | A | 2/1985 | Della-Moretta | 244/137 R |
| 4,512,106 | A | 4/1985 | Roche | 49/445 |
| 4,552,481 | A | 11/1985 | Bluett | 403/165 |
| 4,600,331 | A | 7/1986 | Gray | 403/165 |
| 4,669,907 | A | 6/1987 | Patton | 403/78 |
| 4,955,749 | A | 9/1990 | Panovic | 403/11 |
| 5,267,906 | A | 12/1993 | Kitchen et al. | 472/118 |
| D346,423 | S | 4/1994 | Kitagawa | D22/134 |
| D346,734 | S | 5/1994 | Rohr | D8/349 |
| 5,399,042 | A | 3/1995 | Ivel | 403/165 |
| 5,421,783 | A | 6/1995 | Kockelman et al. | 472/135 |
| 5,423,438 | A | 6/1995 | Swanson | 212/275 |
| 5,494,367 | A | 2/1996 | Epkens | 403/164 |
| 5,502,850 | A | 4/1996 | Lyne, Jr. | 5/11 |
| 5,527,223 | A | 6/1996 | Kitchen et al. | 472/118 |
| 5,529,421 | A | 6/1996 | Epkens | 403/164 |

(List continued on next page.)

*Primary Examiner*—Kien T. Nguyen
(74) *Attorney, Agent, or Firm*—Pate Pierce & Baird

(57) ABSTRACT

A multidirectional amusement device is shown having a support structure extending above a support surface. A ride vehicle is secured to the support structure with support lines and is allowed to move freely beneath the support towers. A retraction tower receives a tow line connected to the ride vehicle to draw the ride vehicle to a desired height. A release mechanism attached between ends of the tow line engages a stop on the retraction tower and automatically releases the ride vehicle into a pendulum motion. The ride vehicle includes an attachment portion for receiving the support lines. The ride vehicle also includes a rider platform rotatably attached to the attachment portion. The ride vehicle further includes a coupling bar having a first end pivotally secured to the attachment portion of the ride vehicle and a second end extending outwardly from the ride vehicle for engaging the release mechanism. The coupling bar helps initiate a rocking motion which, in combination with the pendulum motion and the rotation motion, maximizes the thrill factor of the multidirectional amusement device. Redundant cabling, secured to each other at space intervals, adds safety to the system.

33 Claims, 20 Drawing Sheets

U.S. PATENT DOCUMENTS

| | | | | | |
|---|---|---|---|---|---|
| 5,573,465 | A | | 11/1996 | Kitchen et al. | 472/118 |
| 5,607,248 | A | | 3/1997 | Hasse | 403/78 |
| 5,628,690 | A | * | 5/1997 | Spieldiener et al. | 472/131 |
| 5,658,201 | A | | 8/1997 | Kleimeyer et al. | 472/44 |
| 5,772,350 | A | | 6/1998 | Ferguson et al. | 403/78 |
| 5,810,671 | A | | 9/1998 | Balwanz et al. | 472/118 |
| 5,842,928 | A | | 12/1998 | McGinnis | 472/118 |
| 5,931,740 | A | | 8/1999 | Kitchen | 472/118 |
| 5,989,127 | A | | 11/1999 | Kitchen et al. | 472/44 |
| 6,017,071 | A | | 1/2000 | Morghen | 294/94 |
| 6,032,993 | A | | 3/2000 | Kwon | 294/1.1 |
| 6,315,250 | B1 | | 11/2001 | Meyer | 248/74.1 |
| 6,349,985 | B1 | | 2/2002 | Aston | 294/1.1 |
| D456,827 | S | | 5/2002 | Butts | D15/143 |
| 6,511,381 | B1 | * | 1/2003 | Cochron | 472/46 |

* cited by examiner

MULTIDIRECTIONAL AMUSEMENT DEVICE

RELATED APPLICATIONS

The present application is a continuation-in-part of my patent application Ser. No. 10/007,599, filed Nov. 13, 2001 now U.S. Pat. No. 6,511,381, and entitled A MULTIDIRECTIONAL AMUSEMENT DEVICE, which is related to, and claims priority from, U.S. Provisional Application No. 60/247,301, entitled "Multidirectional Ride Vehicle With Release Bar," filed Nov. 10, 2000, which are both hereby incorporated by reference in their entirety.

BACKGROUND OF THE INVENTION

1. The Field of the Invention

The present invention relates to an amusement ride and more particularly, a multidirectional amusement device for raising a passenger vehicle into the air and permitting a limited free fall experience when the vehicle is released into a horizontal and vertical translation through a vector rotation.

2. Technical Background

Amusement park thrill seekers are no longer satisfied with the rides and roller coasters of the past. Owners of amusement parks and fun centers are increasingly upgrading their attractions to create a higher thrill level and more intense ride experience for their patrons. One way to increase the thrill of a ride is to add a "free fall" element to the ride or attraction. Some have attempted to do this with the use of bungee cords. However, repeated stretching of a bungee cord may break down the cord such that it performs at dangerous levels. Other rides may include parachute drops or other types of drops coupled with complex deceleration devices such as hydraulic brakes or friction breaking systems. These high tech breaking devices are quite complex and costly and require constant and vigilant maintenance to guard against fatal accidents.

One attraction that provides the illusion of free fall is the giant swing. Giant swings do not require complex breaking devices, and they can utilize cables that do not stretch and that are more predictable. One such giant swing device is taught in Kitchen U.S. Pat. No. 5,931,740. In the Kitchen patent however, each rider is only permitted to face in one direction during the flight of the swing, which reduces the amount of thrill factor involved in the ride. Further, the release mechanism must be manually operated. Other giant swing attractions are not efficiently raised and lowered and thus, can only accommodate lower numbers of patrons over a fixed period of time. This increases the cost of the ride. Still other giant swing devices have questionable safety systems for protecting ride patrons.

Accordingly, it would be an advancement in the art to provide an amusement device that allows the rider to safely rotate while moving in a multitude of directions. It would be a further advancement to provide such a device that maximizes the free fall element of the ride. It would be yet another advancement in the art to provide such an device that can efficiently accommodate larger number of riders. It would be yet another advancement in the art to provide such a device that has improved safety features. Such an amusement device is disclosed and claimed herein.

SUMMARY OF THE INVENTION

The apparatus of the present invention has been developed in response to the present state of the art, and in particular, in response to the problems and needs in the art that have not yet been fully solved by currently available swing devices. Thus, it is an overall objective of the present invention to provide a novel multidirectional amusement pendulum device that is efficiently operated, safe, and yet maximizes the thrill factor of the system.

To achieve the foregoing advantages and objectives, and in accordance with the invention as embodied and broadly described herein in the preferred embodiment, a novel multidirectional amusement device is provided. The amusement device may include one or more support structures or towers extending above a support surface such as a parking lot, tarmac, or other ground surface. A ride vehicle is attached with support lines or cables to the support towers in such a way as to allow the ride vehicle to move back and forth beneath the support towers in a horizontal and vertical translation through a vector rotation. In one embodiment, multiple support lines are attached at a first end to the support structure and at a second end to the ride vehicle. The support lines may also be attached to each other at spaced intervals which prevents a broken support line from falling to the ground and injuring someone.

A retraction tower may reel in a tow line connected to the ride vehicle. As the ride vehicle is pulled up toward the retraction tower, a release mechanism secured to the tow line interacts with a stop attached to the retraction tower. The release mechanism may include a lever positioned such that when the lever engages the stop, the lever pivots, disengaging the ride vehicle from the release mechanism and allowing the ride vehicle to move downward under the force of gravity. The ride vehicle moves through a horizontal and vertical translation by vector rotation until it comes to a stop beneath the support structure.

In one embodiment, the tow line may be secured at a first end to the support structure or to a tether positioned between multiple support structures. A second end engages the retraction tower and in one preferred embodiment, a winch in the retraction tower. The release mechanism may be secured to the tow line between the first end and the second end such that when the ride vehicle is at rest beneath the support structure, the release mechanism hangs beneath the support structure adjacent the ride vehicle. The release structure may include a weight to allow the release mechanism to return to a position adjacent the ride vehicle beneath the support structure under the force of gravity. This allows for more efficient loading of the amusement device because the release mechanism is returned to a convenient position.

The ride vehicle may include an attachment portion to which the support lines are attached. A rider platform may be rotatably attached to the attachment portion at a connection point. The platform may be attached to a central post at one end, with the opposing end of the central post rotatably attached to the attachment portion. With the platform rotatably connected to the attachment portion, riders in seats attached to the platform are allowed to rotate and travel through a horizontal and vertical translation by a vector rotation. In one embodiment the platform is symmetrical about the control post which allows for smooth rotation of the platform. The ride vehicle may also include a fail-safe member positioned about the connection point. The fail-safe member may include a first end secured to the attachment portion. A second end may be configured to engage the central post below the connection point. Accordingly, the fail-safe member provides a redundant connection which provides safety in the event the pivotal connection between the attachment portion and the rider platform fails.

The platform 40 of the ride vehicle may include a handle 41 for anchoring the ride vehicle. The handle 41 is configured to act as a breaking device. A brake cable (not shown) may be automatically or manually affixed to the handle 41. It will be appreciated that the handle 41 may be positioned at various positions on the ride vehicle 14 to accomplish this braking function. Additionally, the handle may be configured in a variety of ways to allow the ride operator or a mechanical device to latch onto the ride vehicle 14 toward the end of its pendulum motion. One such configuration may include a hook, a latch and the like.

In one embodiment, a coupling bar having a first end is pivotally secured to the attachment portion of the ride vehicle. A second end may extend outwardly from the ride vehicle a distance of greater than about one foot. The second end may be configured to releasably engage the release mechanism. In this configuration the coupling bar may be used to position the ride vehicle at an angle just prior to release which facilitates an increased rocking motion and gyro motion.

The support structures may include slots or other mechanisms which would allow the first ends of the support wires to movably engage the support structures. This allows the shape of the ride motion to change and can, with proper timing, create an increased free fall sensation.

Accordingly, the amusement device of the present invention provides a giant multidirectional amusement device that allows the rider to safely rotate, and rock back and forth while moving through a horizontal and vertical translation by a vector rotation. It also maximizes the free fall element of the ride while efficiently accommodating larger number of riders because the release mechanism returns to the loading area of the amusement device. The ride device also provides improved safety features.

These and other objects, features, and advantages of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained will be readily understood, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

The presently preferred embodiments of the present invention will be best understood by reference to the drawings, wherein like parts are designated by like numerals throughout. It will be readily understood that the components of the present invention, as generally described and illustrated in the figures herein, could be arranged and designed in a wide variety of different configurations. Thus, the following more detailed description of the embodiments of the apparatus, system, and method of the present invention, as represented in FIGS. 1 through 8, is not intended to limit the scope of the invention, as claimed, but is merely representative of presently preferred embodiments of the invention.

Figure 1:
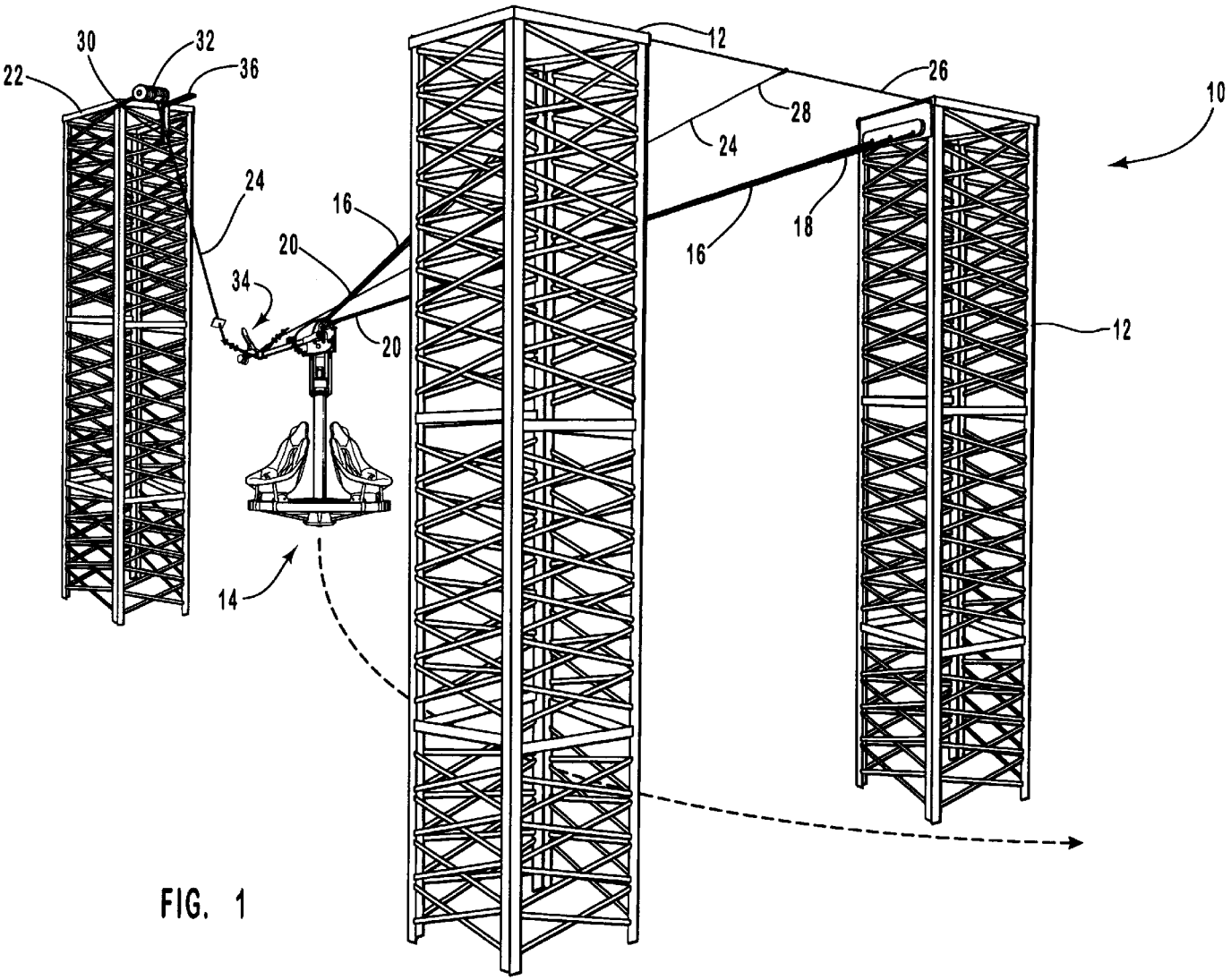
FIG. 1 is a perspective view of the amusement device of the present invention.

With particular reference to FIG. 1, a amusement device according to the present invention is generally designated at 10. The amusement device 10 includes a support structure 12 extending above a support surface. In one embodiment, a pair of support structures 12 extend above a support surface with a ride vehicle 14 attached to each support structure 12 with at least one support line 16, such that the ride vehicle 14 can move freely beneath and between the support structures 12. In one presently preferred embodiment, multiple support lines 16 each include a first end 18 attached to the support structures and a second end 20 attached to the ride vehicle 14. It will be appreciated that in the alternative embodiment where there is just one support tower, an upper portion of the support structure must have an extension portion extending away from the support structure to allow the ride vehicle 14 to travel beneath the extension portion without impacting the support structure 12. The support lines 16 may be steel cables. In a presently preferred embodiment, the strength of each individual cable or support line 16 can hold up to twenty times the weight of the ride vehicle, passengers, and force due to gravity.

The amusement device 10 includes a retraction tower 22 which provides a base to elevate the ride vehicle 14 upward to a suitable starting height for the start of the pendulum motion. A tow line 24 is attached at a first end 28 to the support structure 12 or to a tether 26 positioned between a pair of support structures 12. The tow line 24 movably engages the retraction tower 22. The retraction tower 22 may be fitted with a retracting mechanism 32 for receiving a second end 30 of the tow line 24. In one embodiment, the retracting mechanism 32 is a winch 32 attached to the retraction tower 22. The retracting mechanism may also be any number of hydraulic or pneumatic rams operating alone or in connection with a cable/pulley system.

It will be appreciated by those of skill in the art that the retracting mechanism can be positioned relative to the support tower, or the angle of retraction can be manipulated to retract the ride vehicle 14 in a non-perpendicular plane relative to the plane defined by the ride vehicle in a non-retracted position, and two spaced points of attachment of the support lines to the support structure 12. Depending upon how the ride vehicle 14 is secured to the support structure 12, the ride will have a natural swing or movement through a plane. That plane is most likely perpendicular to the plane determined by three points. The point where the ride vehicle 14 hands freely beneath the support structure 14 under the force of gravity, and the point where support lines 16, or sets of support lines 16 attached the ride vehicle 14 to the support structure 12. Once the ride vehicle 14 is released, the forces acting on the device 10 will urge the ride vehicle 14 into this natural pendulum plane. By retracting the ride vehicle 14 in an angle relative to the pendulum plane, or in other words, in a non-perpendicular angle relative to the plane defined by the ride vehicle 14 and its attachment to the support structure, the ride vehicle 14, upon release, will experience movement in lateral directions.

A release mechanism 34 may be secured to the tow line 24 between the first end 28 and the second end 30 of the tow line 24. The release mechanism 34 is configured to releasably engage the ride vehicle 14. At a predetermined point, as the tow line 24 is being retracted by the winch 32, the release mechanism 34 engages a stop 36 attached to the retraction tower 22 which causes the automatic release of the ride vehicle 14.

With the first end 28 of the tow line 24 attached to the support structures 12, the release mechanism 34 is easily returned to a point adjacent to the ride vehicle 12 after the pendulum motion is completed and the ride vehicle 14 is at rest beneath the support structures 12. A weight 38 attached to the release mechanism 34 aides in the return process. This configuration allows for more efficient attachment of the ride vehicle 14 to the release mechanism 34, and allows more riders to use the amusement device 10 during a fixed period of time. This in turn increases profits.

Figure 2:
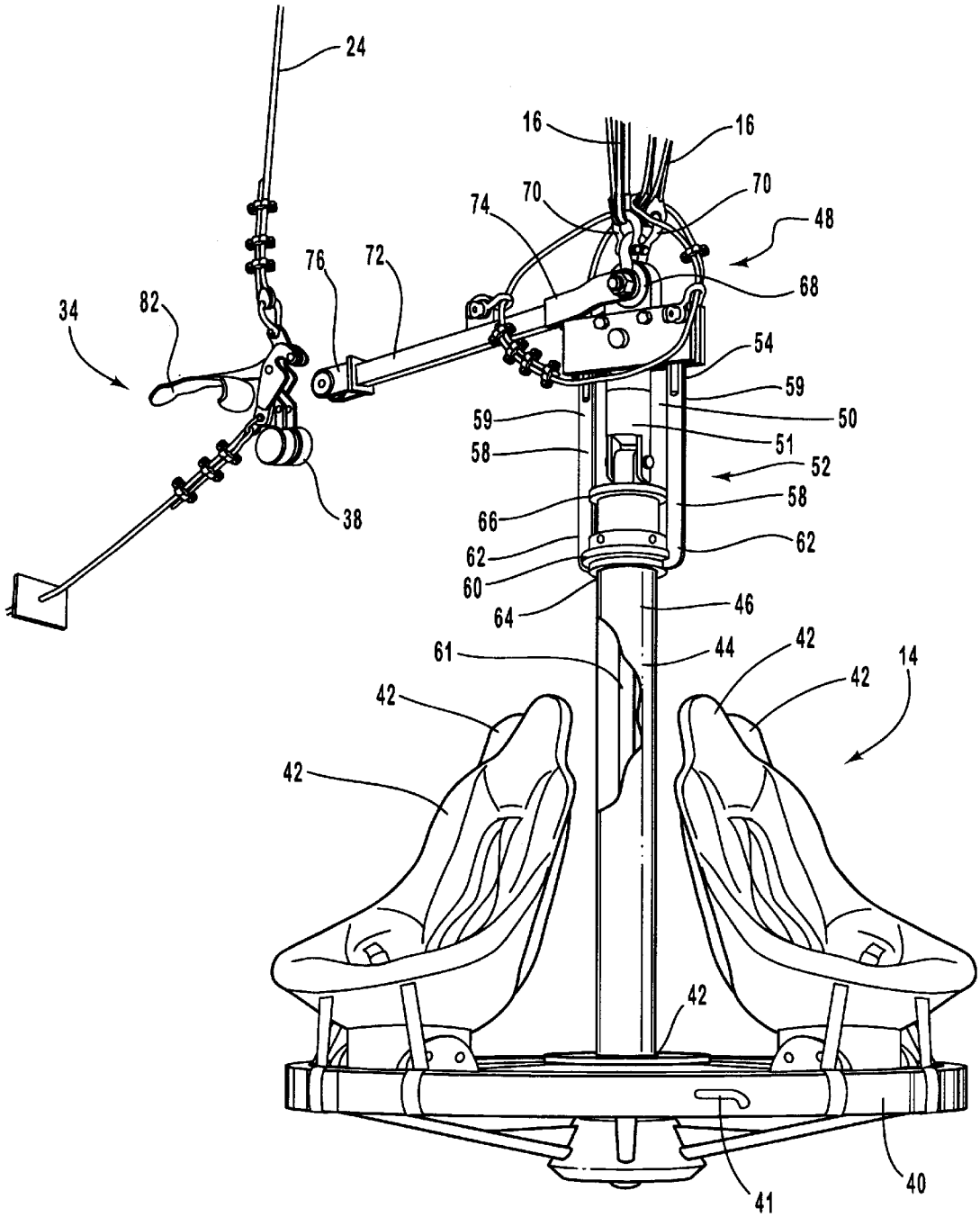
FIG. 2 is a perspective view of the ride vehicle and release mechanism of the amusement device of FIG. 1.

Turning now to FIG. 2, the ride vehicle 14 includes a platform 40. The platform 40 may be fitted with one or more rider seats 42. The rider seats 42 may face inwardly or outwardly. The platform 40 may also be configured with slates to secure a rider in the prone or standing position, or in an angled position, to the ride vehicle 14. The seats or other rider supports may be attached in ways known in the art, such at welding, bolting, riveting, and the like. In one embodiment, the rider seats are attached using two separate attachments to increase safety. It will be appreciated that attachment redundancies act as a fail-safe in case the first method of attachment fails. It will further be appreciated that a variety of belts, bars, or harnesses may be used to secure the rider to the ride vehicle 14.

In one embodiment, the platform 40 is attached to a first end 42 of a central post 44. A second end 46 of the central post 44 is rotatably connected to an attachment portion 48 of the ride vehicle 14 at a connection point 50. The rider platform 40 is thus rotatably connected to the attachment portion or plate at the connection point. The connection point may be part of a universal joint 51 of a kind known in the art. A rod member 61 may be attached at the first end of the central post and at a second of the central post 44 adjacent the connection point. Preferably, the rod member 61 is positioned within the central post 44 and acts as a redundant safety connection. The rod member may also be attached to the universal joint 51 itself. In one embodiment, the attachment portion 48 is a plate member 48 configured to receive the universal joint 51. The support central post 44 defines a central axis about which the platform 40 is allowed to rotate. In one embodiment, the platform 40 may be substantially symmetrical about the central post 44. In this configuration, the platform may rotate more smoothly about the central post 44. Accordingly, the ride vehicle 14 not only moves through a giant arc, but may simultaneously rotate about the central post 44 while swinging, thus increasing the thrill factor of the amusement device 10.

The ride vehicle 14 further comprises a fail-safe member 52 positioned about the connection point 50. The fail-safe member 52 is a backup connection device for the connection point 50 which rotatably secures the platform 40 to the plate member 48. The fail-safe member 52 includes a first end 54 secured to the attachment portion or plate 48. A second end 56 of the fail-safe member 52 is configured to engage the central post 44 below the connection point 50. The fail-safe member 52 may include a pair of bars 58 positioned parallel to, and on either side, of the central post 44. A ring member 60 may be secured to bottom ends 62 of the bars 58. Upper ends 59 of the bars 58 are secured to the plate member 48. The ring member 60 defines an opening 64 in which the central post 44 is positioned and allowed to freely rotate. An annular flange 66 is secured to the central post 44 above the ring member 60. The diameter of the flange 66 is greater than the diameter of the ring member 60 such that if the universal coupling fails, the ring member 60 will capture the central post 44, and thus the platform 40, and the attachment portion will stay engaged to the platform 40. The ride vehicle 14 may also include a solid rod (not shown) which runs through the central post 44 and separately attaches to the plate member 48 and the platform 40 adding an additional level of safety should the central post 44 fail.

In one embodiment, a coupling bar 72 is affixed to the plate member 48. The coupling bar 72 includes a first end 74 which is pivotally secured to the ride vehicle 14 at an eyelet 68 configured within the plate member 48. A second end 76 of the coupling bar 72 extends outwardly from the ride vehicle 14. As will be discussed in greater detail below, the second end 76 is configured to releasably engage the release mechanism 34. In one embodiment, the coupling bar 72 extends outwardly from the ride vehicle 14 at least about one foot. In another embodiment, the coupling bar 72 extends outwardly from the ride vehicle 14 between about two feet and about seven feet. The coupling bar 72 allows the release mechanism 34 to be coupled to the ride vehicle 14 at a position spaced apart from where the support lines 16 attach to the ride vehicle 14. This significantly decreases the possibility that the release mechanism 34 will interfere with the support wire 16 attachment to the ride vehicle 14, and vice versa. The release mechanism 34 is positioned between the first and second ends 28,30 of the tow line 24 such that the release mechanism 34 rests substantially adjacent the ride vehicle 14 even when unattached.

Figure 3:
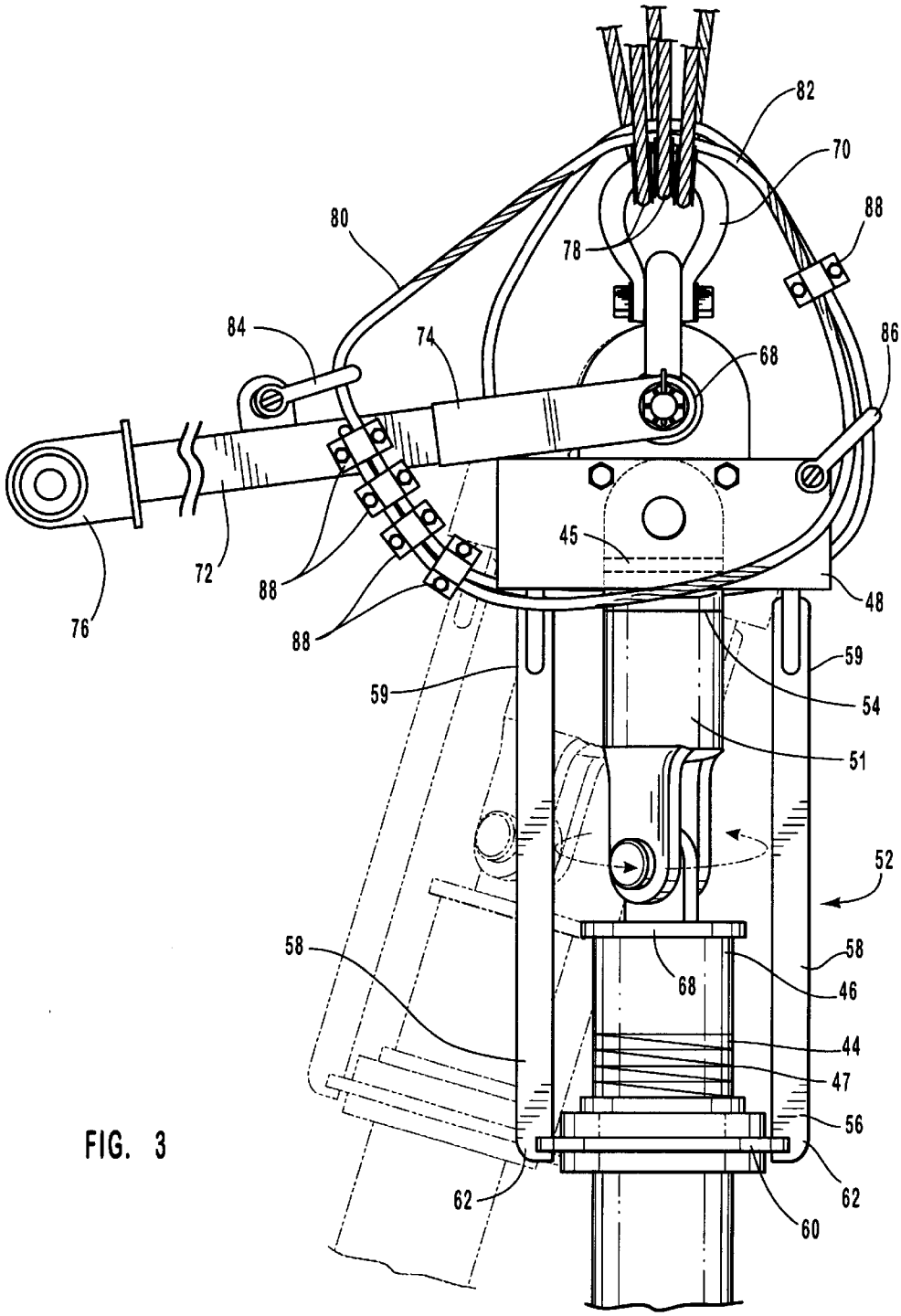
FIG. 3 is a side plan view of a portion of the ride vehicle showing multiple axis of rotation.

Referring now to FIG. 3, the eyelet 68 of the plate member 48 may contain annular ball bearings to facilitate the pivoting (shown in phantom) of the ride vehicle 14 with respect to the support lines 16. An eyebolt 70 may be coupled to the eyelet 68 to allow for rocking in a lateral direction to the direction of the pendulum movement. Thus, the ride vehicle 14 can pivot, oscillate, and move through several degrees of freedom. This multidirectional rocking movement, added to the rotational and pendulum movement adds to the thrill of the device 10. This increases the thrill factor of the amusement device 10. This rocking motion can also be enhanced with the coupling arm 74. If the coupling arm 74 is limited in its range of pivotal motion, the ride vehicle 14 is forced at an angle under the force of the retracting tow line 24. At the time of release, the force is removed and the ride vehicle 14 pivots relative to the point of attachment of the support wires 16 to the attachment plate 48, at the eyelet 68, starting a rocking motion in conjunction with the pendulum and multidirectional motion.

In one presently preferred embodiment, the support lines or cables 16 are protected by ring sheaths 78. The ring sheaths 78 reduce the stress, wear and tear on the support line or cables 16 and protect each support line or cable 16 from grating against an adjacent support line or cable 16 during operation of the amusement device 10. The rotating motion of the platform 40 relative to the attachment plate 48 also prevents the cables 16 from twisting around each other and causing shear stress. It will be appreciated by those of skill in the art that the spacing the points of attachment of the support cable 16 to the support structure 12, or the spacing of a pair of support structures, will also help prevent the support cables 16 from twisting.

The multidirectional amusement device may also include a dampener 45 which absorbs a downward jolt to the ride vehicle. In various embodiment, the dampener 45 may include a shock absorber, a compression spring, hydraulic or pneumatic devices alone or in various combinations. The dampener may also be positioned at various places to absorb the initial jolt created by the free fall action after release of the ride vehicle 14 from the release mechanism 34. For example, in one embodiment, the dampener 45 may be positioned between the support lines 16 and the attachment plate 48. In other embodiments, the dampener 45 may be part of the attachment of the first end of the support lines 16 to the support structure. In the embodiment of FIG. 3, a second dampener 47 is positioned about the central post 44 to serve as a shock absorber for the fail-safe member 52. The dampener 47 is a compression spring.

The coupling bar 72 includes a second connection to the ride vehicle 14. The second connection 80 includes a cable 82 wrapped twice through an eye bolt 84 connected to the coupling bar 72 and an eye bolt 86 attached to the plate member 48. The cable 82 is bolted to itself with a plurality of cable bolt clamps 88 to complete the loop. In this configuration, the coupling bar 72 has a separate or second connection to the ride vehicle 14. This redundancy adds safety and protects against failure of the eyelet 68 which secures the coupling bar 72 to the ride vehicle. It will be appreciated by those of skill in the art other ways may be implement to provide a fail-safe second attachment of the coupling bar 72 to the ride vehicle 14. These may include a second coupling bar or a differently configured tether.

Figure 4A:
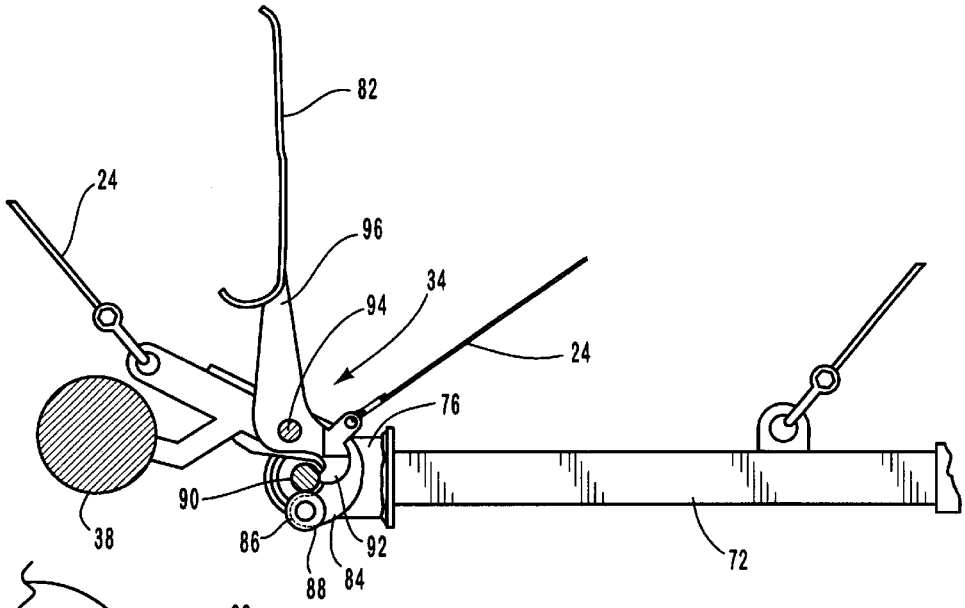
FIG. 4A is a side plan view of the release mechanism of FIG. 1.
Figure 4B:
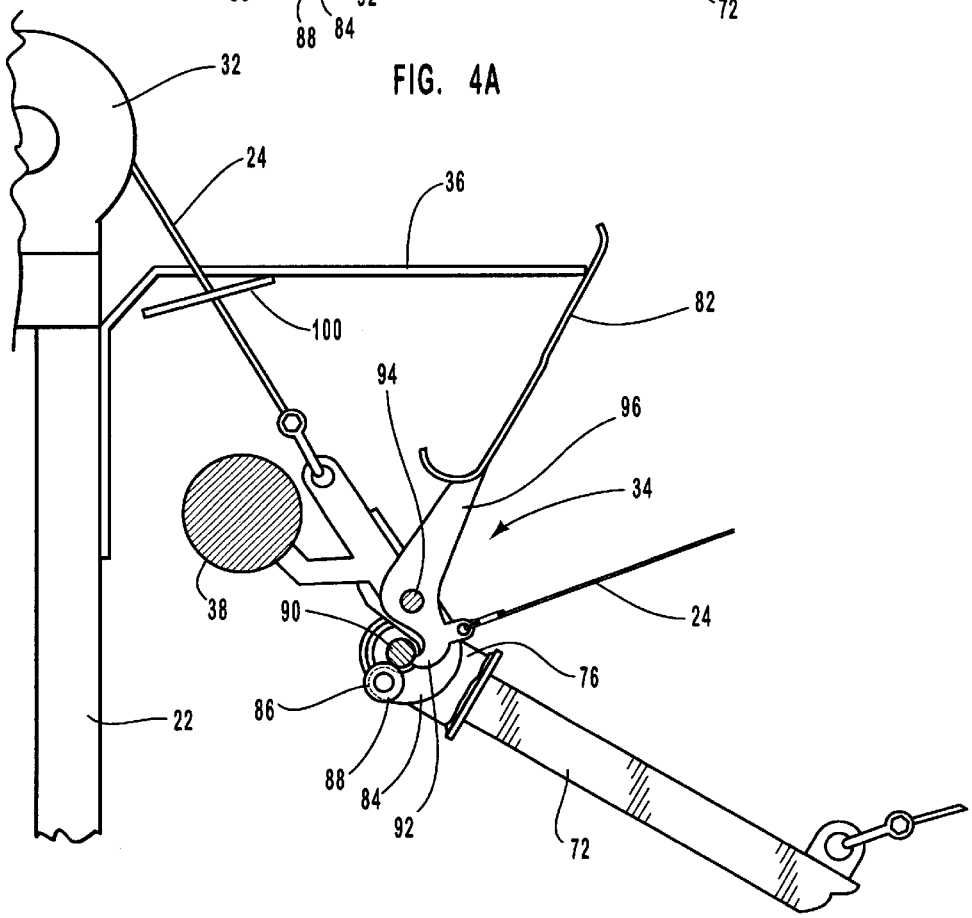
FIG. 4B is a side plan view of the release mechanism of FIG. 1 engaging a support structure stop.
Figure 4C:
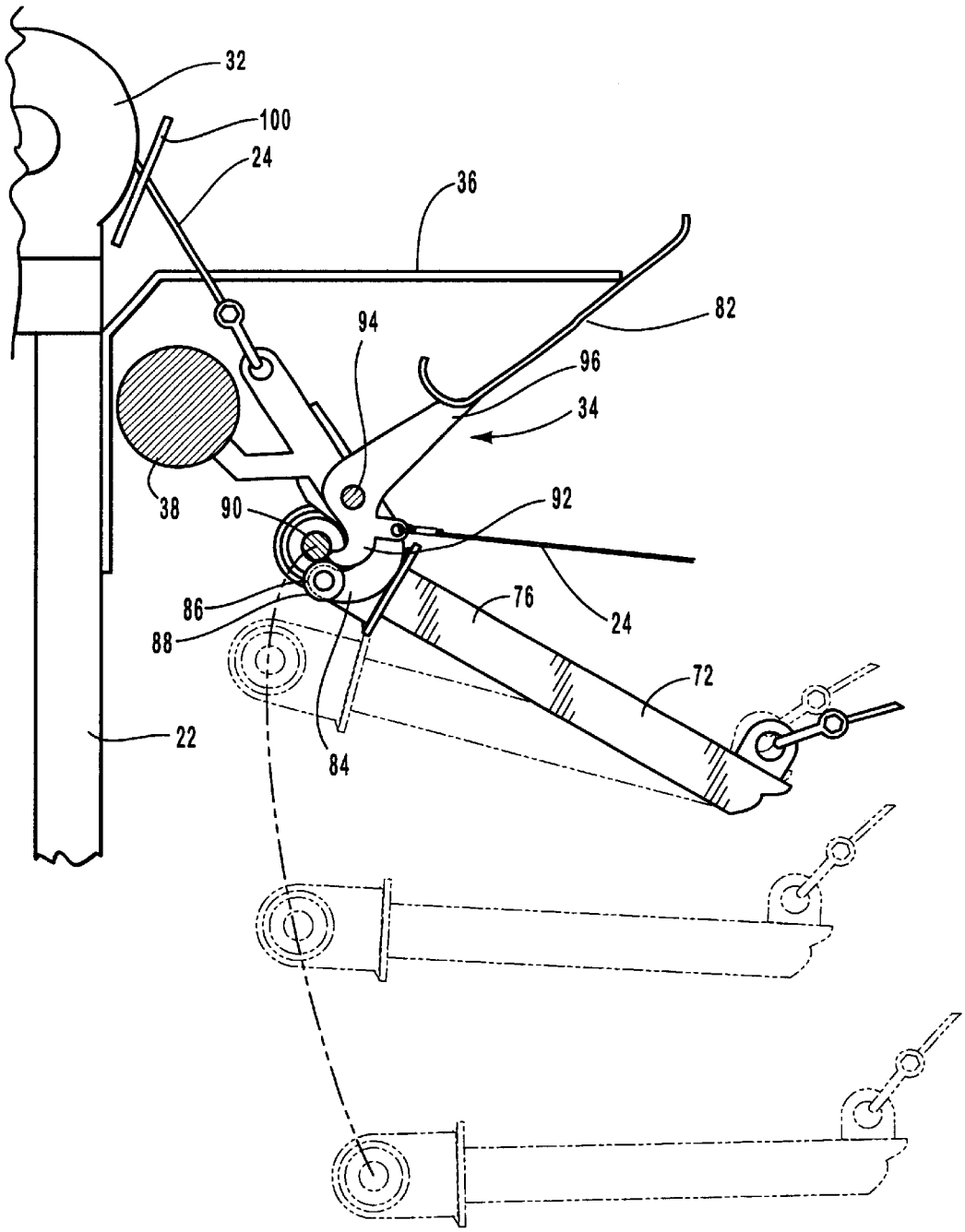
FIG. 4C is a side plan view of the release mechanism of FIG. 1 showing the ride vehicle disengaging the release mechanism in phantom.

Turning now to FIGS. 4A–4C, the automatic release of the release mechanism 34 from the coupling bar 72 of the ride vehicle 14 is illustrated. The release mechanism 34 includes a lever 82 and hook 84. The hook 84 has a cylindrical bushing 86 rotatably connected at the end 88 of the hook 84. When the release mechanism 34 is attached to the coupling bar 72, a post 90 configured within the second end 76 of the coupling bar 72 is captured by the hook 84. A projection member 92 is integral with the lever 82. The projection member 92 is positioned adjacent the bolt 90 on the opposite side of a pivot point 94 from an arm 96 of the lever 82. When the lever 82 and lever arm 96 of the release mechanism 34 engages the stop 36, the lever 82 pivots about the pivot point 94 forcing the projection member 92 into the post 90 of the coupling arm 72. The cylindrical bushing 86 rotates and the post 90 is forced off of the hook 84 over the bushing 86 and the ride vehicle 14 is automatically disengaged from the tow line 24 allowing the ride vehicle 14 to start its motion through a horizontal and vertical translation by a vector rotation.

The tow line 24 includes a stop plate 100 which protects the winch 32 from engaging the release mechanism 34. It will be appreciated that the release mechanism 34 can be secured to the tow line 24 in a variety a positions to allow the automatic release of the ride vehicle 14 at a predetermined height, relative to the retraction tower 22.

Figure 5:
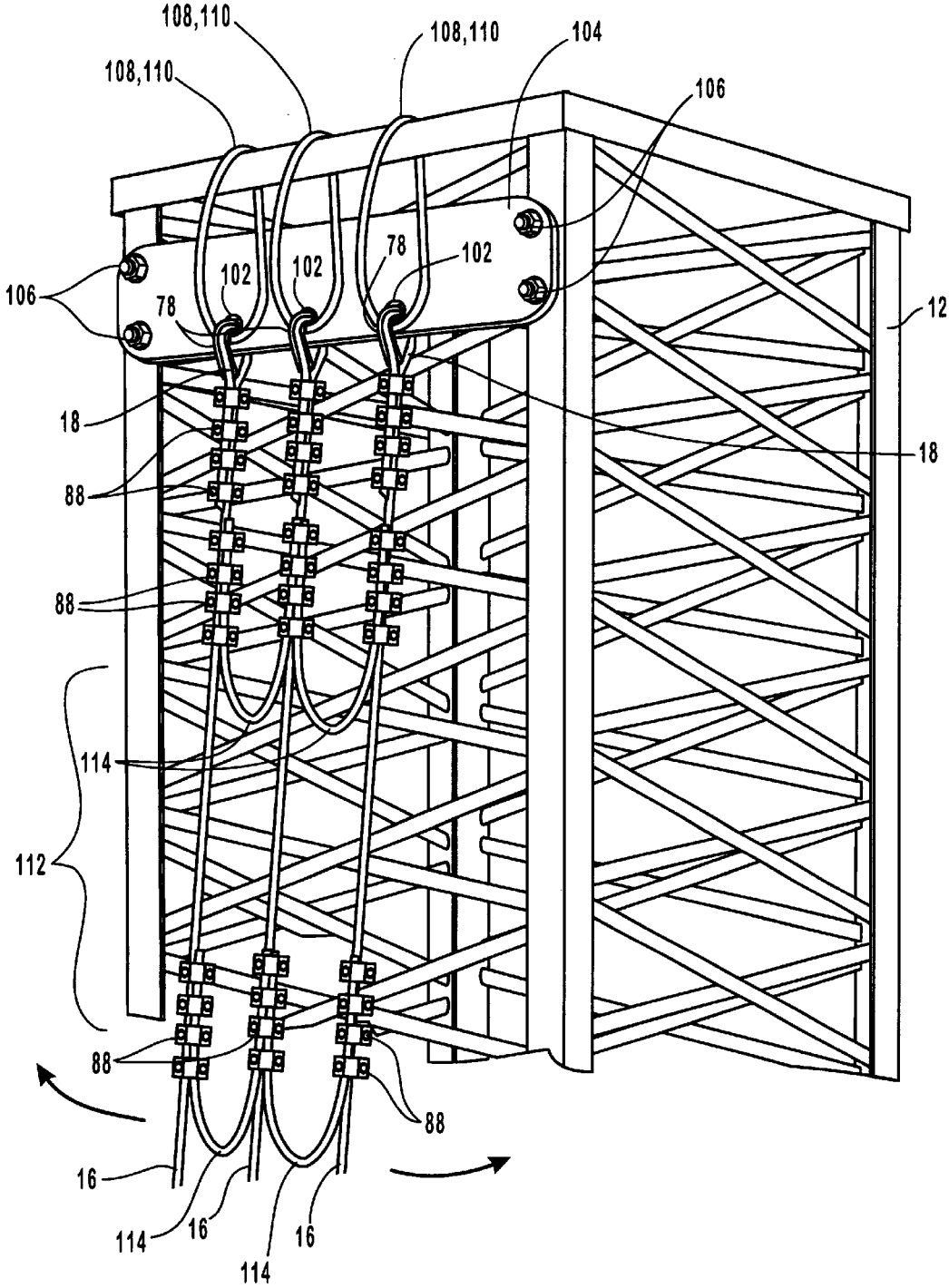
FIG. 5 is a perspective view of the support structure of FIG. 1.

Turning now to FIG. 5, a plurality of support lines 16 are used to secure the ride vehicle 14 to each support structure 12. In the embodiment shown, three cable are used. Each support line 16 is secured to the support structure 12 by looping the first end 18 through an orifice 102 in a plate 104 secured to the support structure 12 by bolts 106. Each looped end is then secured to itself by multiple cable bolt clamps 88. The support lines may also be fitted with ring sheaths 78 to protect the ends 18 of the support lines or cables 16 against shearing.

In one embodiment, the support lines 16 are moored to their respective support structures 12 in orifices 102 that are spaced apart form each other. Using multiple support lines 16 reduces the wear and tear on any one individual support line 16 by dividing the load. As the ride vehicle 14 oscillates in pendulum motion, the weight load is shifted from on support line 16 to the next. Preferably, each support line 16 is of sufficient strength to support the entire load of the ride vehicle 14.

Each support line 16 also has a second connection 108 to the support structure 12. In one embodiment, a tether cable 110 is threaded through the looped first end 18 of the support line 16 and secured to a separate area of the support structure 12, distinct from the plate 104. Accordingly, if the plate 104 fails, the second connection 108 will support and maintain the support lines 16 in connection with the support structure 12.

Each of the support lines 16 attached to a support structure are attached to each other at spaced intervals 112. The support lines 16 may be secured together with one or more tether cables 114. The tether cables 114 are bolted at respective ends to the support lines 16 with cable bolt clamps 88. The tether cables 114 should be long enough to not substantially interfere with the action of any individual support line 16. The support lines 16 for the amusement device 10 of the present invention are long and could pose a potential danger if the entire length of the support line 16 were to fall to the ground. By tethering the support lines 16 together, the amount that any portion of a broken support line 16 falls can be controlled. In one embodiment, the support lines 16 are secured to each other at equal intervals of about four feet. Additionally, if a support line 16 should break, the load previously support by that support line 16 is transferred to the other two support lines 16 through the tether cable 114.

Figure 6:
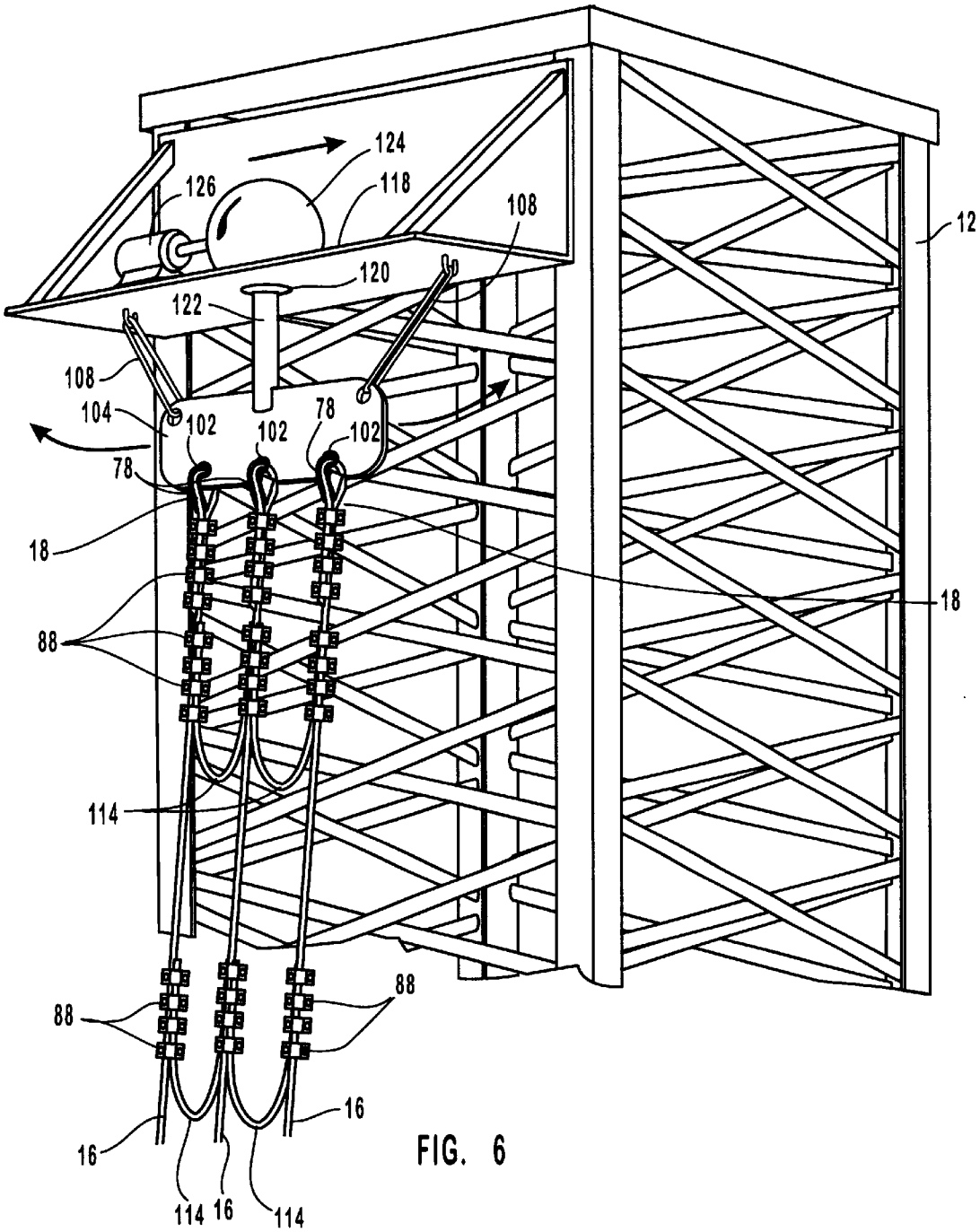
FIG. 6 is a perspective view of an alternative embodiment of the support structure of FIG. 1.

Referring now to FIG. 6, an alternative embodiment of the present invention is shown. In this embodiment, the first end 18 of the support line 16 movably engages the support tower 12. By allowing for movement of the attachment point of the support lines 16 to the support structure, the effective length of the support lines can be modify to affect the period of the oscillation of the ride vehicle 14 through the horizontal and vertical translation by a vector rotation. It will be appreciated by those of skill in the art that by changing the effective lengths of the support lines 16 at particular times during the motion of the ride vehicle 14, the ride vehicle 14 can be accelerated into a faster motion, or decelerated into slower or dampened motion. This configuration increases the thrill factor of the ride and also provides a breaking or slow down system.

In the embodiment in FIG. 6, the plate 104 is pivotally attached to support structure platform 118. The support structure platform 118 includes an orifice 120 in which a shaft 122 is positioned. The shaft is attached at one end to the plate 104 and at an opposing end to a sphere 124. A plunger 126 may engage the sphere causing the plate 104 to pivot and the first ends 18 of the support lines 16 to move back and forth in an arc having a horizontal component.

Figure 7:
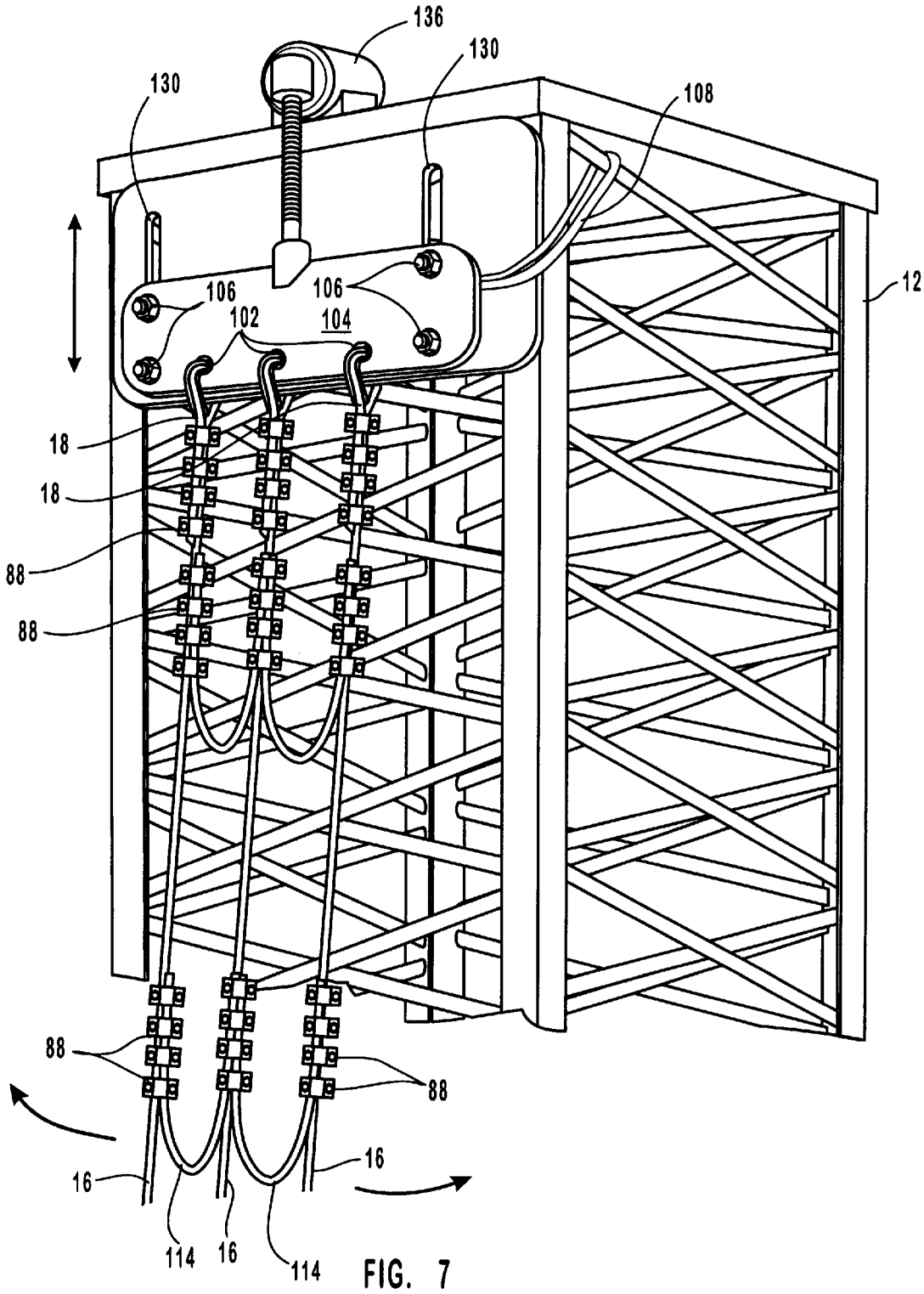
FIG. 7 is a perspective view of another alternative embodiment of the support structure of FIG. 1.
Figure 8:
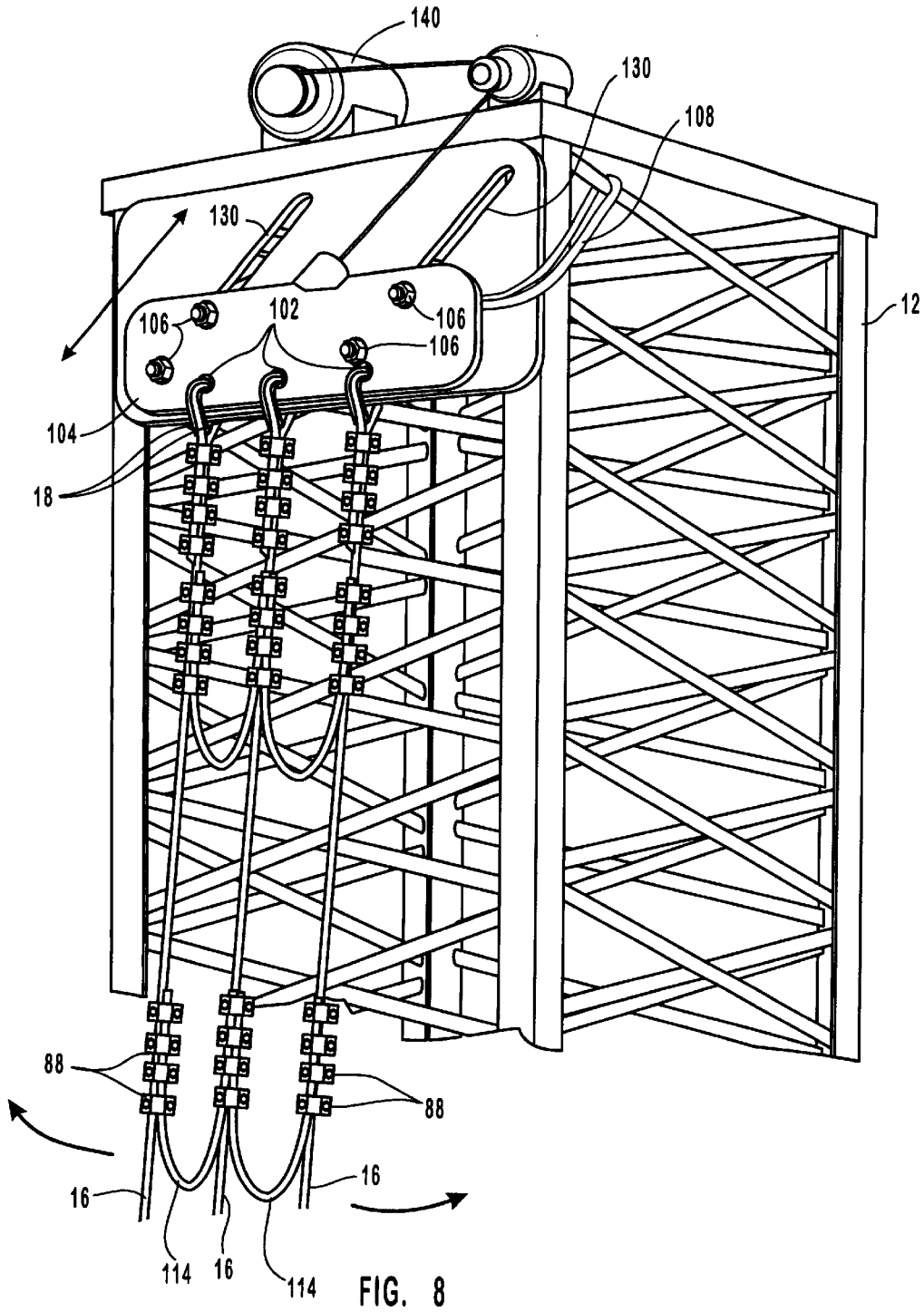
FIG. 8 is a perspective view of another alternative embodiment of the support structure of FIG. 1.

Referring now to FIGS. 7 and 8, alternative embodiments are shown which include different methods of slidably attaching the support lines 16 to the support structure 12. In the embodiment of FIG. 7, vertical slots 130 are configured within the support structure 12 to allow the plate 104 to ride vertically within the slots 130. A worm drive 136 may be utilized to control movement of the plate 104 and attached first ends 18 of the support lines in a vertical direction. In FIG. 8, the slots 130 are at an angle which allows the support lines 16 to move in a direction that is neither horizontal nor vertical. FIG. 8 also illustrates that the movable engagement of the support lines 16 relative to the support structure 12 may be accomplished using a winch 140 or other motor-driven device. It will be appreciated by those of skill in the art that the first ends 18 of the support lines 16 may be configured to movably engage the support structure 12 in a variety of ways to accomplish the teachings of this invention.

Referring again to FIGS. 1 and 2, in operation, a mounting platform (not shown) may be positioned under the ride vehicle 14 to assist in loading and securing riders in the ride vehicle 14. The mounting platform may then be moved away. The release mechanism 34 is secured to the coupling bar 72 of the ride vehicle and the tow line 24 draws the ride vehicle 14 toward the retraction tower 22. The retraction tower is positioned closer to the support structure than the distance between the first end and the second end of the support line. It will be appreciated that this will create some slack in the support wires 16 as the ride vehicle 14 nears the retraction tower 22. Accordingly, upon release, there is an increased free fall element to the ride motion. When the support lines 16 become taut, the attachment plate 48 accelerates forward tipping the ride vehicle 14. This action increases the rocking and oscillating action of the ride vehicle 14 in multiple directions, increasing the thrill factor of the device 10.

As the tow line 24 is drawn in, the lever 82 of the release mechanism engages the stop 36 secured to the retraction tower 22 which causes the ride vehicle 14 to disengage the release mechanism 34 and move through a horizontal and vertical translation through a vector rotation until the force of gravity causes the ride vehicle 14 to come to rest beneath the support structures 12. Handles 41 may be secured to the platform 40 of the ride vehicle 14 to facilitate manually slowing or stopping the motion of the ride vehicle 14 at the end of the pendulum motion. A mounting platform may be used to help riders disembark the sing device 10. The release mechanism 34 is then lowered, with the help of the weight 38 down to a position adjacent the ride vehicle 14.

Figure 9:
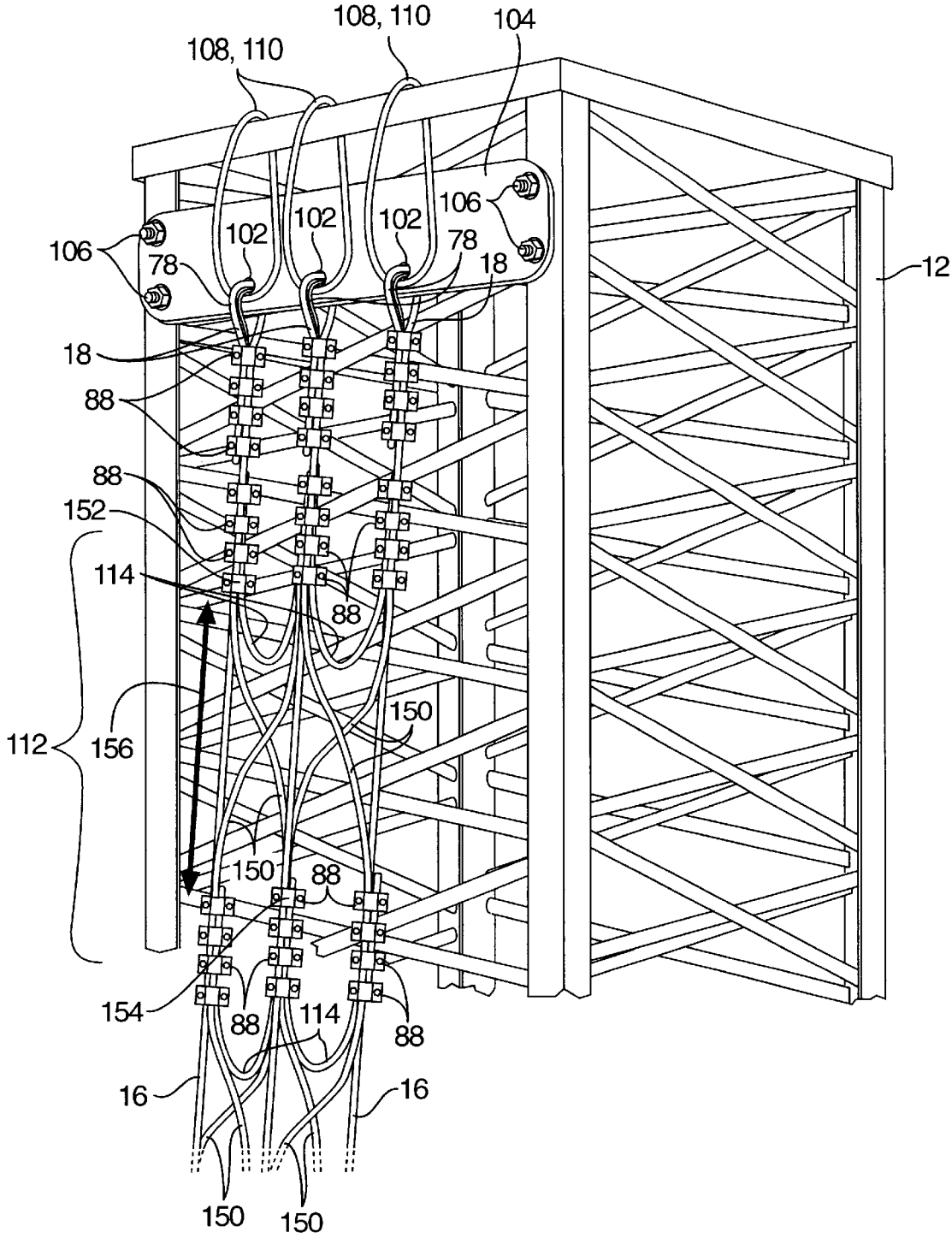
FIG. 9 is a partial perspective view of an alternative configuration for support cables in accordance with the invention.

Referring to FIG. 9, In certain embodiments cross cables 150 may secure at one end 152 to a cable 16 and at an another end 154 to another cable 16 a distance 156 from the end 152. The diagonal securement of the cross cables 150 may lessen impact loading of remaining cables 16 should a single cable 16 fail.

Figure 10A:
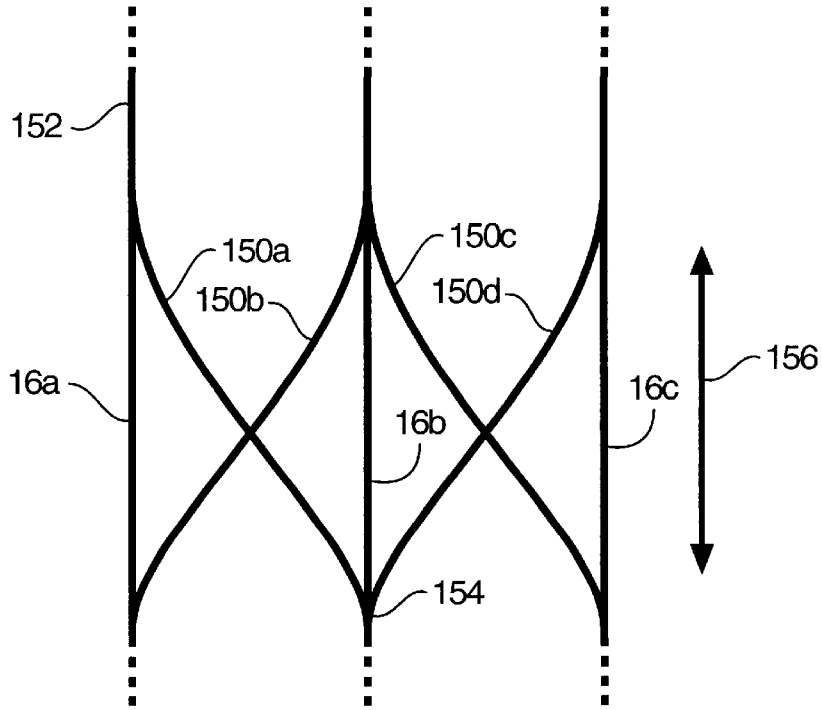
FIGS. 10A and 10B are schematic representation of the support cables of FIG. 9 before and after failure of one of the support cables.
Figure 10B:
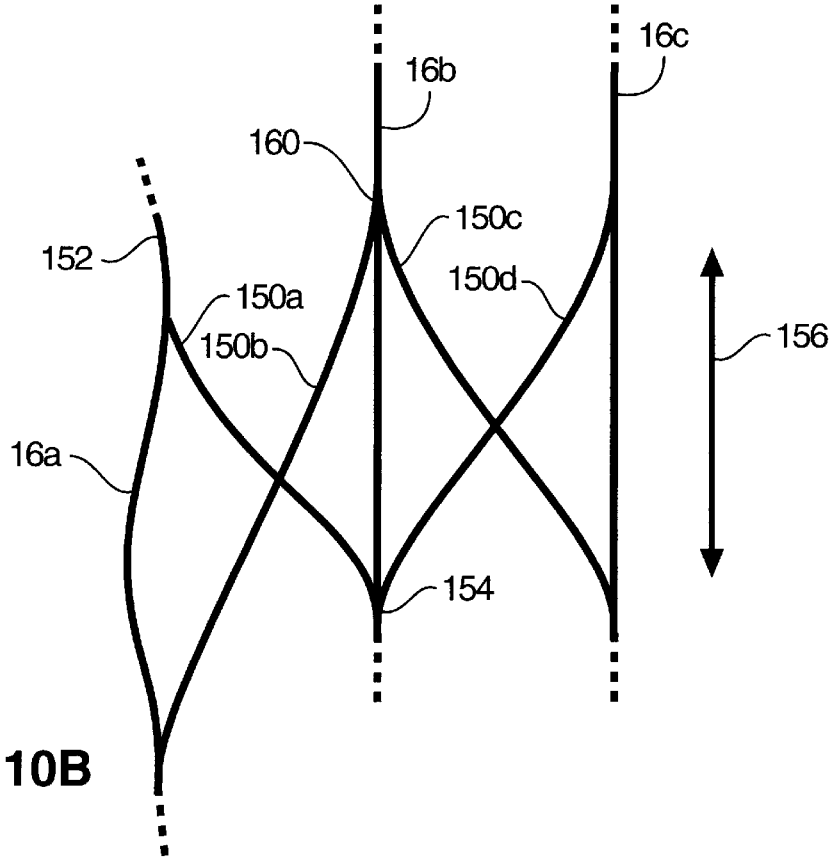

Referring to FIGS. 10A and 10B, if the cables arranged as shown were to fail at a point at or above point 152, the cross cable 150*b* will transfer the load carried by the cable 16*a* to the cable 16*b* as shown in FIG. 10B. The diagonal orientation of the cross cables 150*a*–150*d* ensures that the arrangement of the cross cables 150*a*–150*b* prior to failure more closely approximate the orientation of the cross cables 150*a*–150*b* will assume when actually loaded due to failure of a cable 16*a*–16*c*.

For example, the cross cable 150*b* as oriented in FIG. 10A is oriented much as it is in FIG. 10B where loading has caused it to be oriented along a line between the securement point of the cable 16*a* (not shown) and the point 160 on the cable 16*b*. In this manner impact loads are lessened because loads are not given as much room to accelerate before load is transferred to another cable, such as cable 16*b* in this example. The first and second support lines 16*a*–*c* and the first and additional cross lines or cables 150*a*–*d* may be metal.

Additional cross lines or cables 16 may be secured to the first support line 16 and to the second support line 16 at spaced intervals along the length of the first and second support lines. The additional cross lines 150 may extend substantially diagonally relative to the support lines. In one embodiment, a first and second cross line 150 extend crosswise relative to each other in crisscross fashion. Thus, a plurality of cross lines 150 may be secured between a first support line 16*a* and a second support line 16*b* with the cross lines 150 extending substantially diagonally relative to the support lines 16.

The first support line 16*a* connected between the support 12 and the vehicle 14 may have a first longitudinal and lateral direction. A second support line 16*b* extending between the support 12 and the vehicle 14 may have a second longitudinal and lateral direction. The first cross-line 150 may extend diagonally between the first support line 16*a* and the second support line 16*b* at angles with respect thereto selected to substantially reduce motion of the first support line in the first longitudinal direction in the event of failure of the first support line.

In one embodiment, a first cross-line 150*a* is directed at angles substantially less than 90 degrees with respect to the first and second support lines 16*a*, 16*b*. In another embodiment, a first cross-line 150*a* is directed at angles less than 75 degrees with respect to the first and second support lines 16*a*, 16*b*. In another embodiment, a first cross-line 150*a* is directed at angles less than 50 degrees with respect to the first and second support lines 16*a,* 16*b.* In another embodiment, a first cross-line 150*a* is directed at angles less than 30 degrees with respect to the first and second support lines 16*a,* 16*b.* In another embodiment, a first cross-line 150*a* is directed at angles less than 10 degrees with respect to the first and second support lines 16*a,* 16*b.*

The first cross-line 150*a* may be directed at angles selected to reduce displacement of the first support line 16*a* in a first longitudinal direction in an amount less than 90 percent of the distance between the first support line and the second support line proximate the first cross-line in the event of failure of the first support line. The first cross-line 150*a* may be directed at angles selected to reduce displacement of the first support line 16*a* in a first longitudinal direction in an amount less than 70 percent of the distance between the first support line and the second support line proximate the first cross-line in the event of failure of the first support line. The first cross-line 150*a* may be directed at angles selected to reduce displacement of the first support line 16*a* in a first longitudinal direction in an amount less than 50 percent of the distance between the first support line and the second support line proximate the first cross-line in the event of failure of the first support line. The first cross-line 150*a* may be directed at angles selected to reduce displacement of the first support line 16*a* in a first longitudinal direction in an amount less than 30 percent of the distance between the first support line and the second support line proximate the first cross-line in the event of failure of the first support line. The first cross-line 150*a* may be directed at angles selected to reduce displacement of the first support line 16*a* in a first longitudinal direction in an amount less than 10 percent of the distance between the first support line and the second support line proximate the first cross-line in the event of failure of the first support line.

Figure 11:
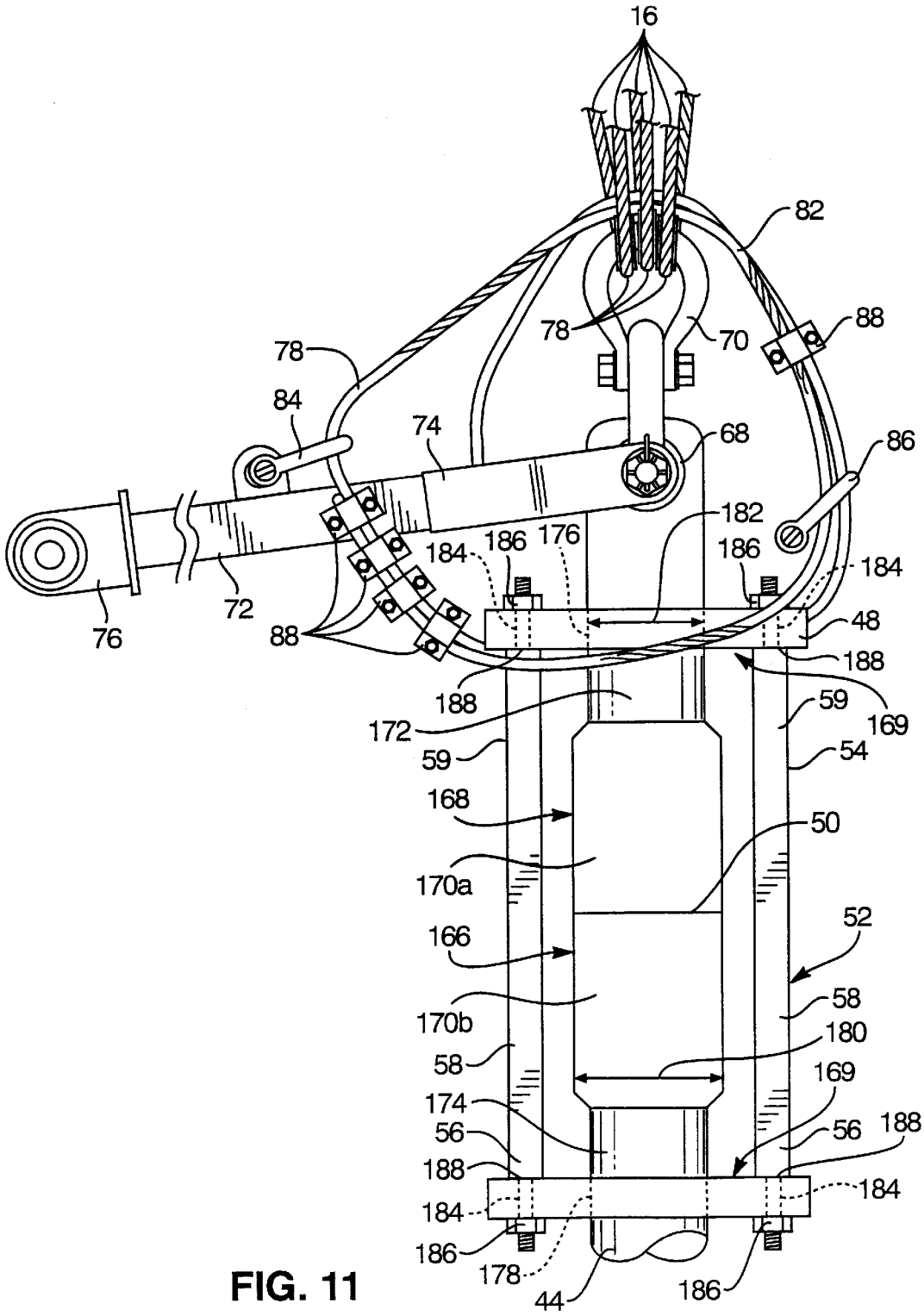
FIG. 11 is a side elevation view of a ride vehicle having an alternative embodiment of a fail-safe member in accordance with the invention.

Referring to FIG. 11, in certain embodiments, a fail-safe member 52 may secure the platform 40 to the cables 16. In certain embodiments the fail-safe member 52 may also provide for rotation of a portion of the fail-safe member 52 with respect to another portion of the fail-safe member 52. This may allow for rotation of the platform 40 relative to the cables 16. In some embodiments a swivel 166 may secure the platform 40 to the cables 16. A swivel 166 may have various embodiments, for example the swivel 166 may be either double or single pivoting. The swivel 166 may have a stop 168 formed thereon to engage a catch 169 effective to prevent separation of the swivel heads 170*a,* 170*b* in the event the swivel 166 should fail. In certain embodiments the stop 168 may be embodied as the swivel heads 170*a,* 170*b* themselves. The catch 169 may be embodied as the plate 48.

In certain embodiments, a head 170*a* may be secured to a shaft 172. A shaft 172 may be a rod, post, or other structure enabling the swivel 166 to be secured to another structure. A head 170*b* may likewise have a shaft 174 secured thereto. The shaft 172 may extend through an aperture 176 in the plate 48 and secure to the cables 16. The shaft 174 may extend through an aperture 178 in a lower plate 179 and secure to the central post 44. Alternatively, the central post 44 may secure directly to the head 170*b.* The diameter 180 of the heads 170*a,* 170*b* may be larger than the diameter 182 of the apertures 176, 178. The top plate 48 and lower plate 179 therefore act as catches 169 engaging stops 168, embodied as the heads 170*a,* 170*b,* to prevent complete failure of the swivel 166.

In certain embodiments the bars 58 may maintain the plates 48, 179 separated from one another by a fixed distance. The bars 58 may extend through apertures 184 formed in the plates 48, 179 and be held in place by fasteners 186 such as bolts, welds, snap rings, or the like. In certain embodiments the bars 58 may have shoulders 188 formed therein serving to prevent the plates 48, 179 from approaching one another. Any number of bars 48 may be used, for example, in the embodiment of FIG. 11, two bars 58 are used. The number of bars 48 may be chosen to ensure sufficient bearing capacity to withstand static and dynamic loads which may result from failure of the swivel 166.

A fail-safe member 52 may be used to couple other components of the apparatus 10 to one another. For example, the fail-safe member 52 may be used to couple the cables 16 to a tower 12. The rotation of the swivel 166 may accommodate the twisting or rotation of the cables 16 caused by the swinging of the platform 40, while providing added security. A fail-safe member 52 may be used in many applications where both swiveling functionality and increased safety are desired.

Figure 12:
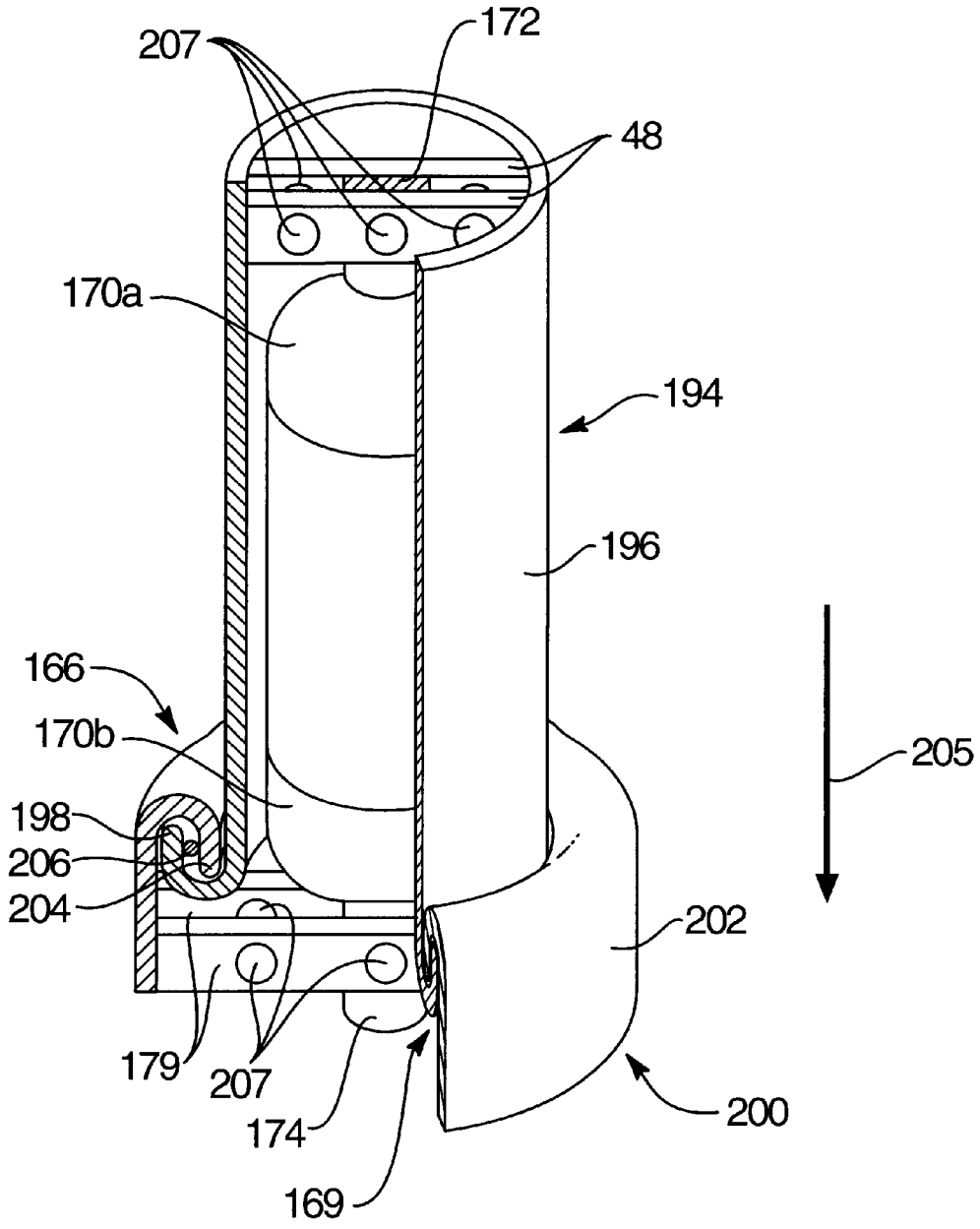
FIG. 12 is a sectional view of an alternative embodiment of a fail-safe member in accordance with the invention.

Referring to FIG. 12, A fail-safe member 52 may be disposed in a variety of configurations. For example, the catch 169 may be mounted to a housing 194. The housing 194 may be embodied as a cylinder 196, or tube 196 of square or polygonal cross section extending around the swivel 166. The catch 169 may be embodied as a flange 198 formed on the housing 194. In certain embodiments the flange 198 may be material forming part of the cylinder 194 that is bent outward from the cylinder 196. In certain embodiments a portion of the flange 198 may extend substantially parallel to the walls of the housing 194 In certain embodiments the flange 198 may be a separate member fastened to the housing 194 by bolts, welds, or the like. The flange 198 may extend substantially continuously around the housing 194, or may be embodied as extensions or ears occurring at distinct locations around the housing 194

The stop 168 may be formed on a retainer 200 engaging the housing 194. In certain embodiments the retainer may be embodied as a ring 202, cylinder 202, or tube 202 of square or polygonal cross section, extending around the swivel 166. The catch 169 may be embodied as a flange 204 formed on the retainer 200. In certain embodiments the flange 204 may be material forming part of the ring 202, or cylinder 202, that is bent toward the center of the ring 202. In certain embodiments a portion of the flange 204 may extend substantially parallel to the walls of the retainer 200. In certain embodiments the flange 204 may be embodied as a separate member fastened to the retainer 200. The flange 204 may extend substantially continuously around the retainer 200, or may be embodied as extensions or ears occurring at distinct locations around the retainer 200.

For embodiments of the flange 198 embodied as periodically placed extensions or ears, the flange 204 may extend substantially continuously around the interior of the retainer 200. For embodiments of the flange 198 embodied as a continuous flange extending around the housing 194, the flange 204 may be embodied as either a continuous band of material, or as periodically placed extensions or ears. In some embodiments the flange 198 maybe formed on the interior of the housing 194. Accordingly, the flange 204 may then extend outwardly from the retainer 200 to engage the flange 198.

The flange 198 may engage the flange 204, effectively preventing the retainer 200 from moving in a direction 205 relative to the housing 194. A seal 206 may be interposed between the flanges 198, 204 to prevent the exposure of the swivel 166 to debris, water, or other contaminants. The housing 194 and retainer 200 may also surround the swivel 166, protecting the swivel 166 from entanglement with, or damage from, cables or the like.

In certain embodiments the top plate 48 may be embodied as a plate 48 or bar 48 extending across the cylinder housing 194. In certain embodiments a pair of plates 48 may be used. The bottom plate 179 may likewise be embodied as a bar 179, plate 179, or pair of plates 179, extending across the retainer 200. The shaft 172 may, accordingly be inserted between the plates 48 and held in place by a weld, pin, bolt, or the like. The plates 48, 179 may have apertures 207 formed therein to serve as attachment points for a cable 16, for example. An aperture 207 may likewise extend through a shaft 172, 174.

The plate 48 may entirely cover one end of the housing 194, helping to limit exposure of the swivel 166 to debris, water, or other contaminants. The bottom plate 179 may also be embodied as a plate 179 extending over the entire opening of the retainer 200 effectively limiting the exposure of the swivel 166 to debris or damaging contact with other components of the apparatus 10.

The shaft 172 may be fixedly attached to the top plate 48, or plates 48. Alternatively, the shaft 172 may extend through the top plate 48, or plates 48, and be rotatable relative thereto. Likewise, the shaft 174 may be either fixedly or rotatably secured to the bottom plate 179, or bottom plates 179. Other structures may, accordingly, secure directly to the shafts 172, 174 or to the plates 48, 179. For example, the cables 16 and the center post 44 may secure to the plates 48, 179. In the embodiment shown, the cables 16 are secured to the top plate 48 and the bottom plate 179 may then, for example, secure to a tower 12.

The plates 48, 179 may secure to the housing 194 by means of welds, bolts, or any other fastener capable of withstanding the forces due to the weight and inertial forces of the ride vehicle 14. In certain embodiments, a plate 48, 179 may be threaded to screw in to one end of a housing 194, or retainer 200. In some embodiments the plates 48, 179, swivel 166, housing 194, and retainer 200 may be secured to the fail-safe member 52 separately. For example the swivel 166, housing 194, and plate 48 may be assembled first. The retainer 200 may then be brought over the housing 194 into engagement with the flange 198. The plate 179 may then be secured to the shaft 174 of the swivel 166 and to the retainer 200. Various other methods and orderings of assembly are possible to manufacture a fail-safe member 52 in accordance with the invention.

Figure 13:
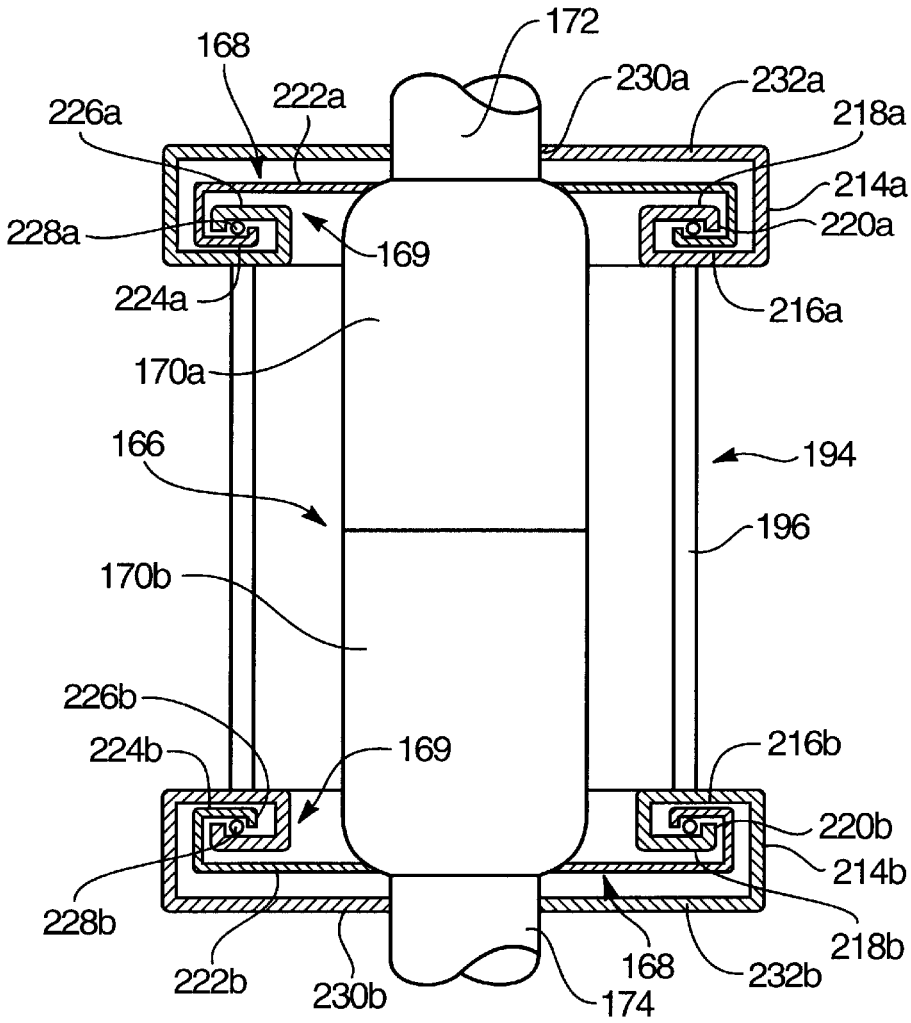
FIG. 13 is a sectional view of an alternative embodiment of a fail-safe member in accordance with the invention.

Referring to FIG. 13, in certain embodiments the housing 194 may have two caps 214*a*, 214*b* on either end. The caps 214*a*, 214*b* may have rims 216*a*, 216*b* either formed thereon, or secured thereto. The rims 216*a*, 216*b* may have flanges 218*a*, 218*b* either formed thereon or secured thereto. A lip 220*a*, 220*b* may also be formed on a flange 218*a*, 218*b*. The heads 170*a*, 170*b* or shafts 472, 474 may have disks 222*a*, 222*b* secured thereto. The disks 222*a*, 222*b* may serve as stops 168. The disks 222*a*, 222*b* may have flanges 224*a*, 224*b* secured thereto or formed thereon. The flanges 224*a*, 224*b* may have a lip 226*a*, 226*b* formed thereon. The flanges 218*a*, 218*b* may serve as catches 169 to engage the flanges 224*a*, 224*b*. A lip 220*a*, 220*b* may engage a lip 226*a*, 226*b* to maintain the flanges 224*a*, 224*b* concentric with the flanges 218*a*, 218*b*. The lips 226*a*, 226*b* may function with the lips 220*a*, 220*b* to engage a seal 228*a*, 228*b* to prevent the entry of contaminants into the housing 194. The shafts 172, 174 may extend through apertures 230*a*, 230*b* in the caps 214*a*, 214*b* in order to secure to a plate 48, plate 179, cable 16, tower 12, or the like.

In some embodiments a disk 222*a*, 222*b* may be formed without a flange 224*a*, 224*b* or lip 226*a*, 226*b*. In a like manner the caps 214*a*, 214*b* may be formed without a flange 218*a*, 218*b* or lip 220*a*, 220*b*. In such an embodiment the disks 222*a*, 222*b* may simply engage the rims 216*a*, 216*b* in order to provide for the possibility of failure of the swivel 166.

In order to manufacture the fail-safe member 52 of FIG. 13, the tops 232*a*, 232*b* of the caps 214*a*, 214*b* may be secured to the caps 214*a*, 214*b* after the other components of the fail-safe member 52 have been assembled. In a like manner the flanges 224*a*, 224*b* may be secured to the rims 216*a*, 216*b* before the flanges 218*a*, 218*b* are secured to the caps 214*a*, 214*b*.

Figure 14:
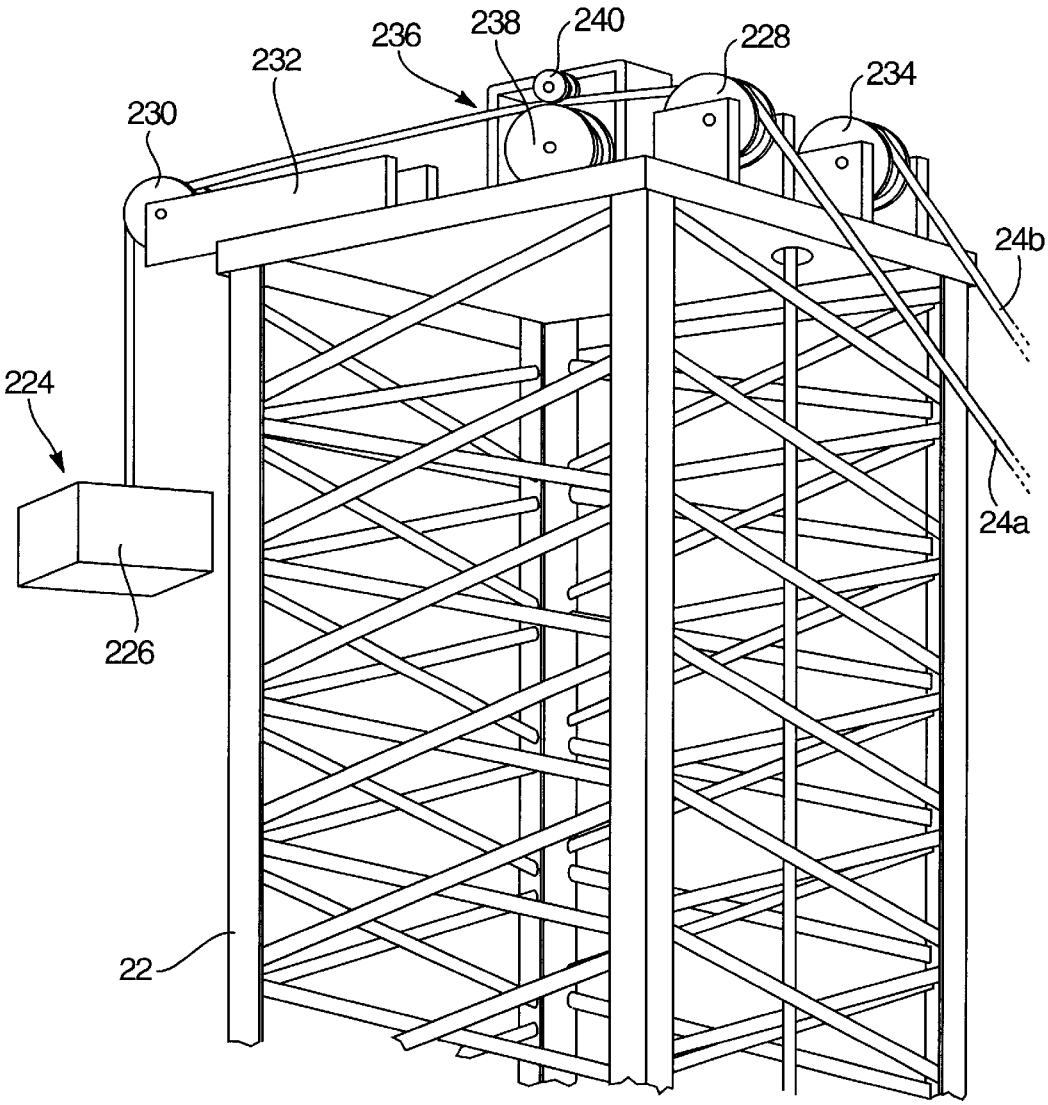
FIG. 14 is a perspective view of a retraction tower and assisting mechanism in accordance with the invention.
Figure 15:
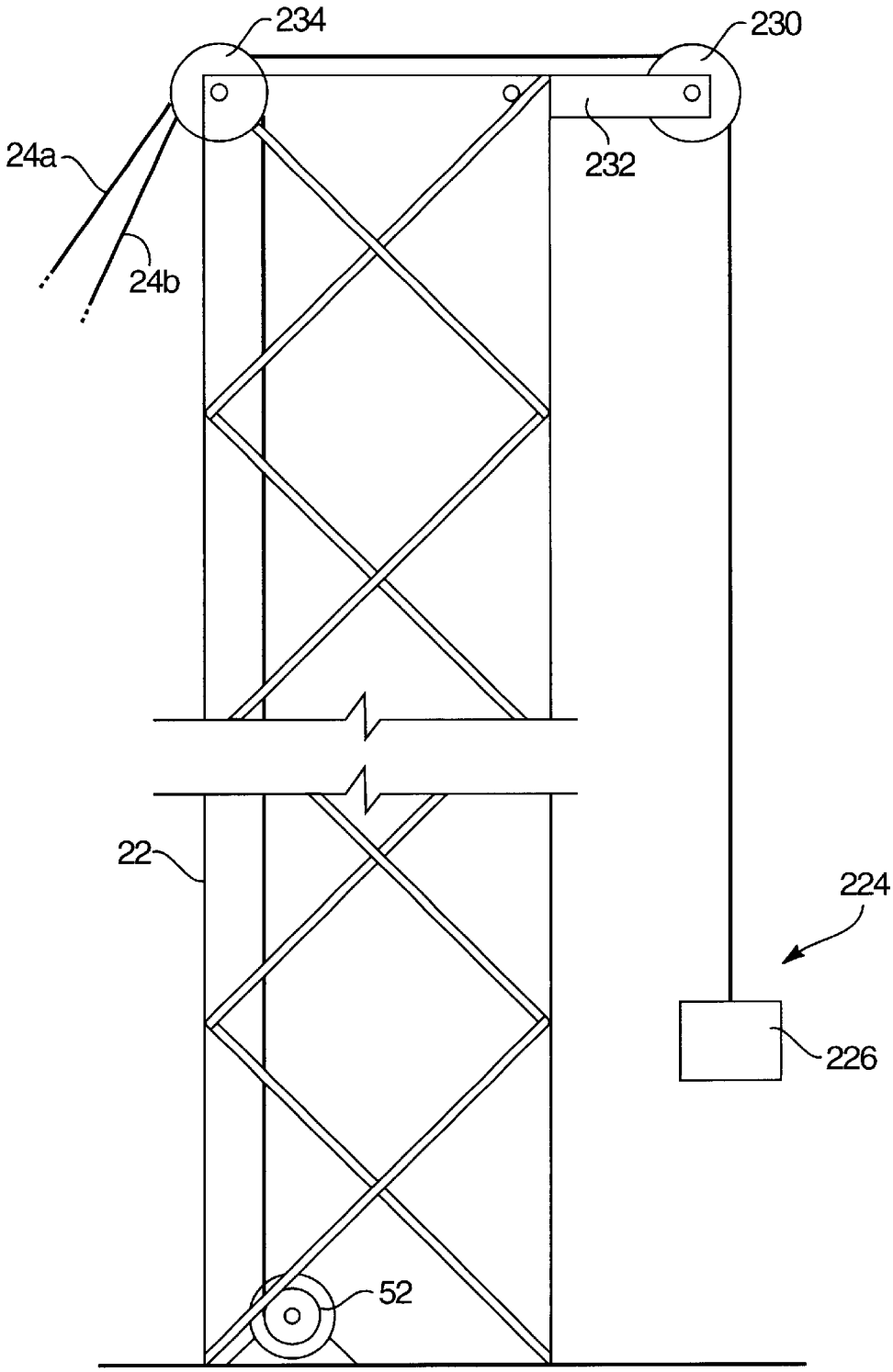
FIG. 15 is a schematic representation of the apparatus of FIG. 24.

Referring to FIGS. 14 and 15, a retracting mechanism 32 may make use of an assist mechanism 224. The assist mechanism may assist the retracting mechanism 32 in pulling the ride vehicle 14 to the top of the retraction tower 22. In certain embodiments the assist mechanism 224 may also provide added safety in the event that the retracting mechanism 32 were to fail. In certain embodiments the assist mechanism may be a counter weight 226 secured to a cable 24*a*. The other end of the cable 24*a* may secure to the ride vehicle 14. The cable 24*a* may extend over pulleys 228 and 230 to permit the cable to wrap over the top of the retraction tower 22.

A driver 236 may serve to raise the counter weight 226 so that the cables 24*a*, 24*b* may be extended to the ride vehicle 14 before the ride vehicle 14 is raised. The driver 236 may be embodied as a driven wheel 238 and an idler wheel 240. The idler wheel 240 may press the cable 24*a* against the driven wheel 238 such that enough friction develops for the driven wheel 238 to raise the counter weight 226. The wheel 238 may be driven by any motor, or the like, such as a hydraulic motor, electric motor, or a pneumatic motor.

A cable 24*b* may wrap over a pulley 234 and be drawn by the retracting mechanism 32 effectively raising the ride vehicle 14. Alternatively, the retracting mechanism 32 may be mounted on top of the tower 22 and the pulley 234 may be unnecessary. The action of gravity on the counterweight 226 may serve to assist the retraction device in raising the ride vehicle 14. In the event that the retracting mechanism were to fail the counter weight 226 may reduce the acceleration of the ride vehicle 14 to minimize harm to the occupants of the ride vehicle 14.

Figure 16:
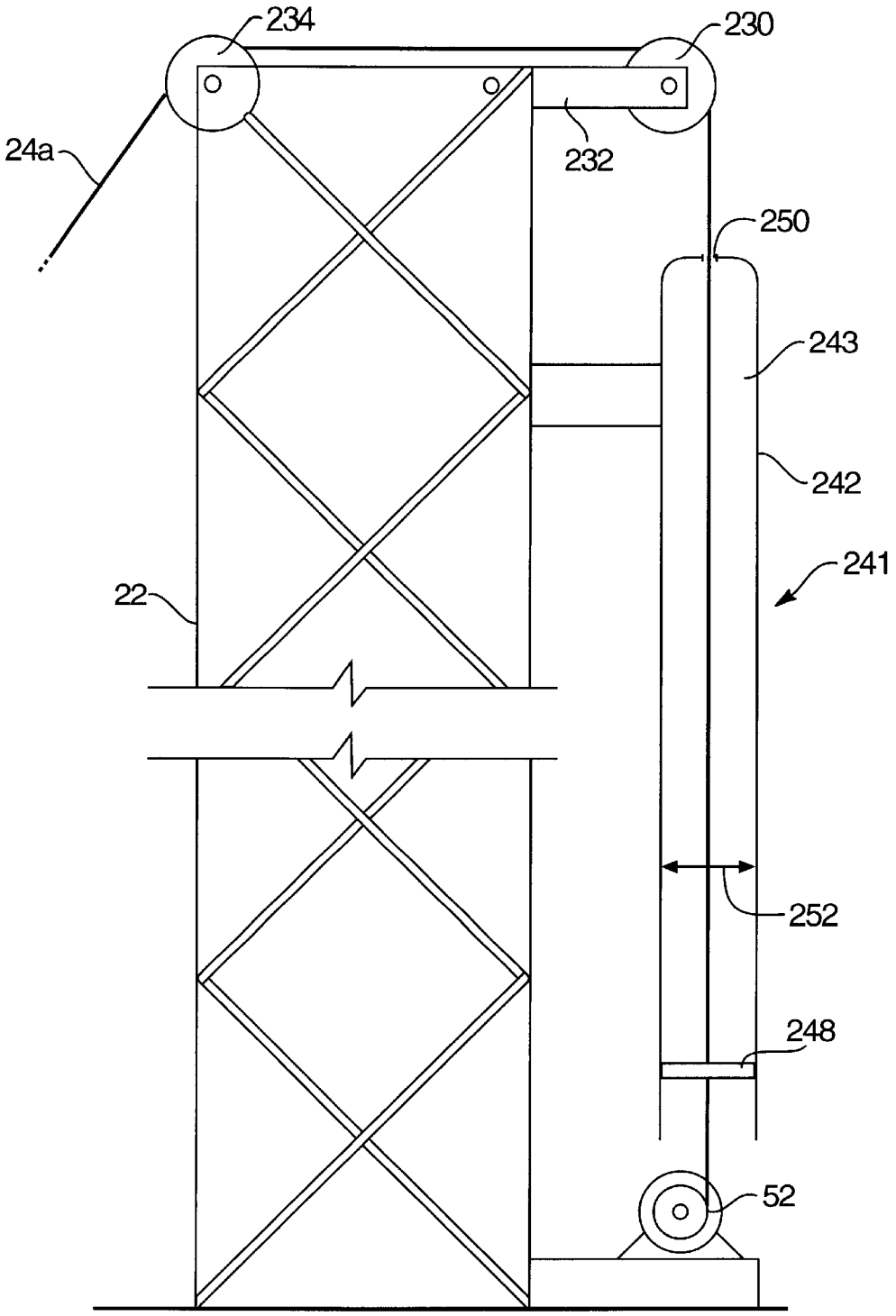
FIG. 16 is a schematic representation of an alternative embodiment of an assisting mechanism and damper in accordance with the invention.

Referring to FIG. 16, In certain embodiments an assist mechanism 224 maybe used with a damper 241 resisting extension and/or retraction of the cable 24*a*. A damper 241 may be embodied as a counter weight 226 suspended within a tube 242. A tube 242 may be at least partially filled with fluid 243. The fluid 243 may enhance resistance to movement of the counter weight 226 within the tube. The fluid 243 may be oil, water, or the like. The fluid 243 may also be air and the clearance between the tube 242 and the counter weight 226 sufficiently small that sufficient resistance is created. The fluid 243 may aid the counter weight 226 in limiting acceleration in the event the retracting mechanism 32 were to fail.

Figure 17:
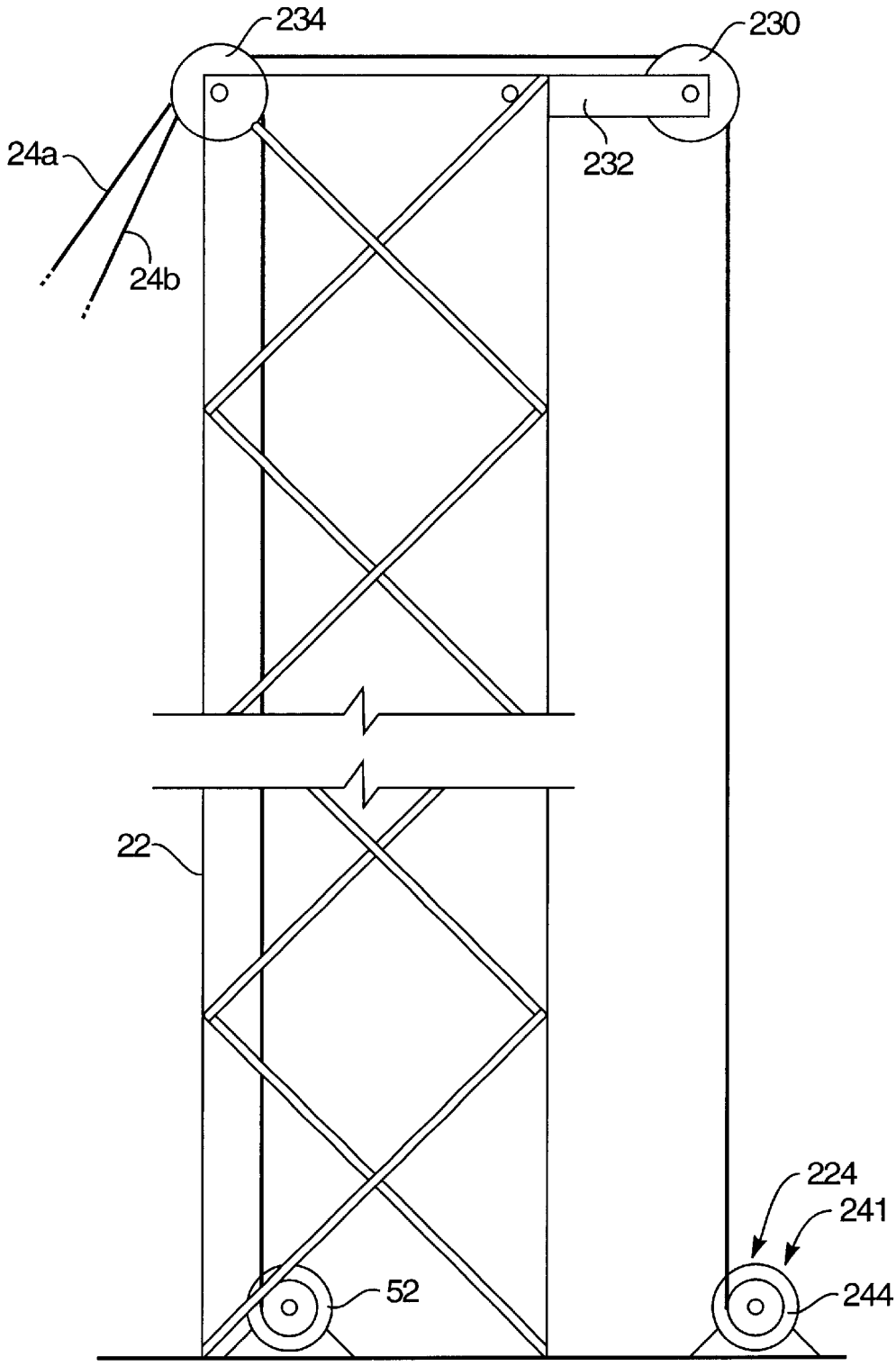
FIG. 17 is a schematic representation of an alternative embodiment of an assisting mechanism and damper in accordance with the invention.

Referring to FIG. 17, in certain embodiments an assist mechanism 224 may be a clutch 244. The clutch 244 may also serve as a damper 241, resisting the downward acceleration of the ride vehicle 14 in the event the retracting mechanism 32 were to fail. The clutch 244 may resist with a constant force or a force that is proportional to the velocity of the ride vehicle 14. The clutch 244 may also have rewind capabilities such as a spring, compressed air, or other biasing means tending to wind the cable 24*a* into the clutch 244. The rewind capabilities may assist the retracting mechanism 32 in raising the ride vehicle 14. The clutch 244 may be a pneumatic, hydraulic, or electric clutch.

Figure 18:
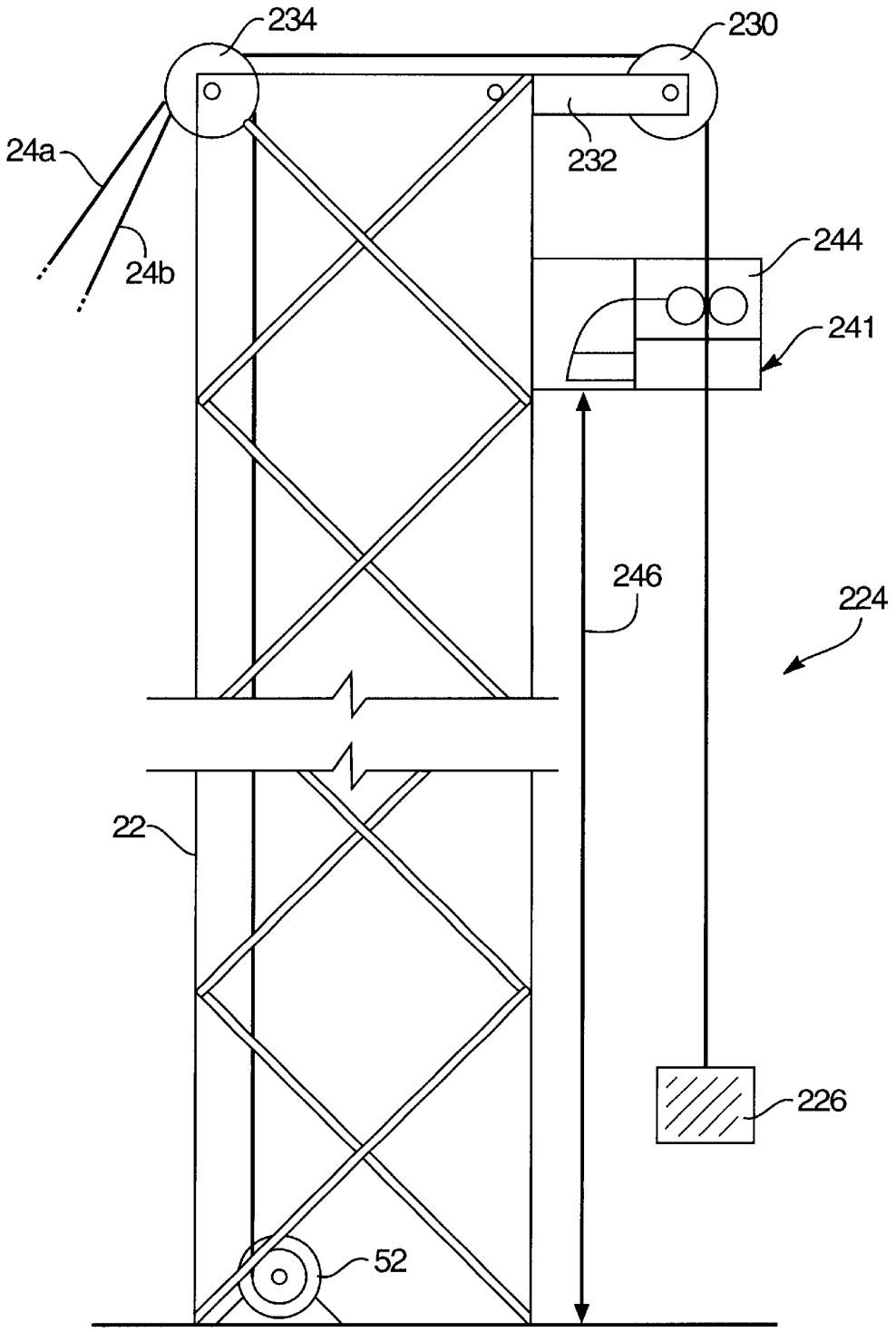
FIG. 18 is a schematic representation of an alternative embodiment of an assisting mechanism and damper in accordance with the invention.

Referring to FIG. 18, in some embodiments a clutch 244 may be positioned a distance 250 from the ground. The clutch 244 may have rollers 252 engaging the cable 24*a* and resisting movement of the cable 24*a* through the clutch 244. A counter weight 226 may secure to the cable 24*a* and serve to assist in raising the ride vehicle and providing greater safety. The clutch 244 of the embodiment of FIG. 18 may or may not have rewind capabilities.

Figure 19:
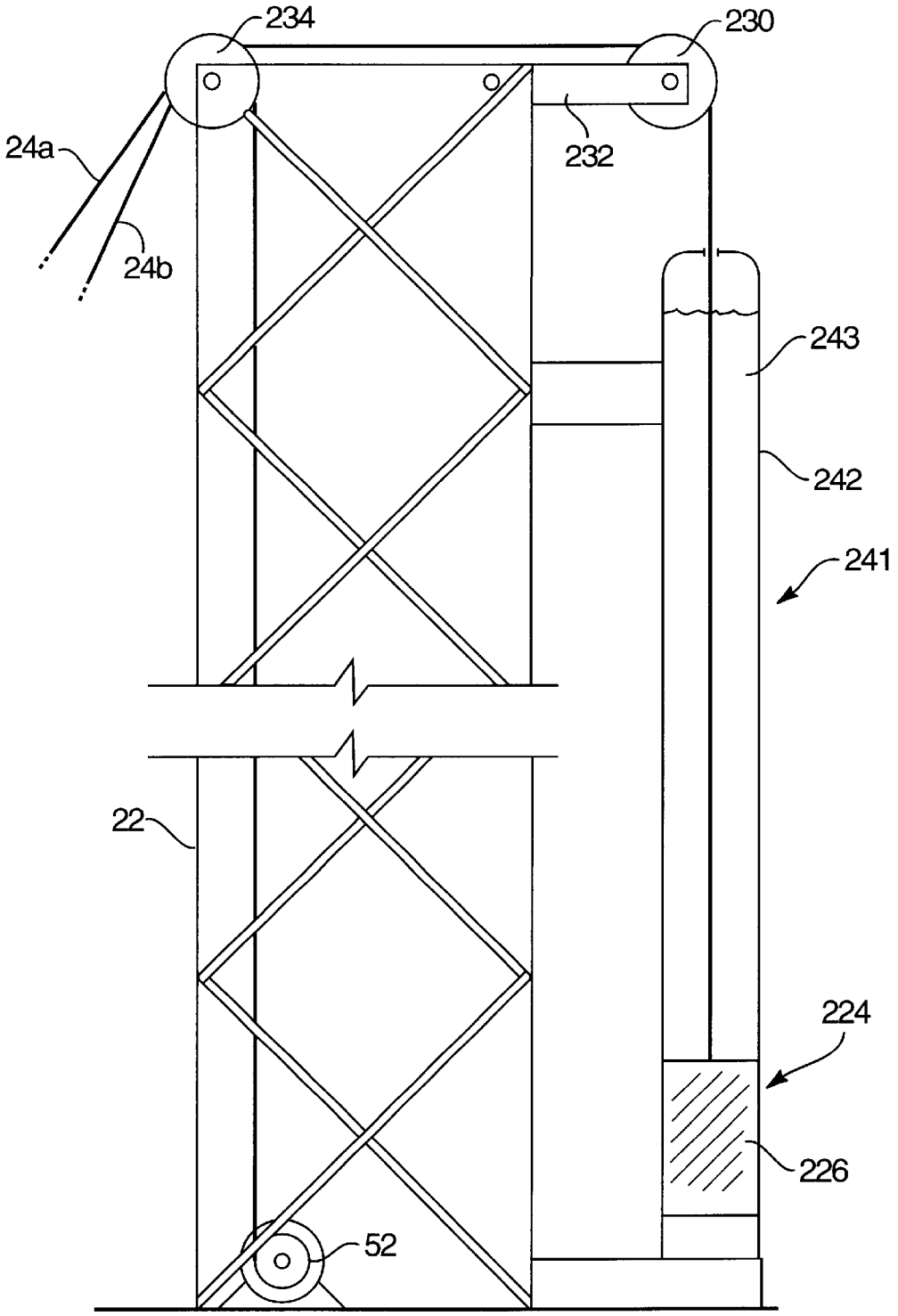
FIG. 19 is a schematic representation of an alternative embodiment of a damper in accordance with the invention.

Referring to FIG. 19, a damper 241 may simply be a piston 248 slidable within a tube 242. The cable 24 may secure to the piston 248 and the drive mechanism 52. An aperture 250 may resist the passage of air out of the cylinder 242. In this manner, if the drive mechanism were to fail, the piston 248 would compress the air in the cylinder 242 in order to absorb energy. The air may be slowly released through the aperture 250 to allow the ride vehicle to lower to the ground. The aperture 250 may be sized to provide sufficient resistence to prevent rapid descent of the ride vehicle 14, while at the same time not presenting excessive resistence to the drive mechanism 52 when the ride vehicle 14 is being slowly raised. This may be possible due to the proportionality of air resistance to the square of the air velocity. The diameter 252 of the tube 242 may be such that enough air is captured between the piston 248 and the tube 242 to absorb significant amounts of energy if the ride vehicle 14 were to fall.

It will be appreciated by those of skill in the art that the assist mechanism, in addition to being used in conjunction with the retracting mechanism 32, may also be employed in conjunction with one or more of the support lines 16 to provide added safety. For example, the assist mechanism in the form of a clutch, piston, or any of the forms discussed above, or like mechanisms, may be positioned between the ride vehicle 14 and one or more support towers or structures 12. In the event that a support line 16 failed, the assist mechanism would slow or prevent the ride vehicle from descending rapidly to the ground.

It should be appreciated that the apparatus of the present invention is capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A load transport comprising:

at least one support extending upward from a support surface;

a vehicle for supporting a load;

at least one support line having a first end and a second end, the support line secured to the support proximate the first end;

a fail-safe member securing the vehicle to the support line proximate the second end of the support line;

a retraction support extending upward from the support surface;

a retracting mechanism secured proximate the retraction support and selectively engagable with the vehicle to draw the vehicle upwardly from the support surface;

an assist mechanism to facilitate the support of the ride vehicle above the support surface; and a release mechanism selectively securing the vehicle to the retracting mechanism.

2. The apparatus of claim 1, wherein the fail-safe member comprises:

a swivel rotatably securing the vehicle to the support line;

a stop secured to the swivel; and a catch positioned between the vehicle and the support line to engage the stop and prevent separation of the ride vehicle from the support line upon failure of the swivel.

3. The apparatus of claim 2, wherein the catch comprises a top support and a bottom support positioned opposite one another with the swivel positioned therebetween;

a retaining structure maintaining the top and bottom support in fixed relation to one another;

and wherein the stop comprises a first head and a second head rotatably secured to one another and forming part of the swivel;

a first shaft being secured to the first head and extending through the top support and a second shaft being secured to the second head and extending through the bottom support, the first head being sized to interfere with the top support to prevent passage of the first head through the top support, the second head sized to interfere with the bottom support to prevent passage of the second head through the bottom support.

4. The apparatus of claim 2, further comprising:

a housing having the catch secured thereto, the swivel positioned within the housing; and a retainer having the stop secured thereto;

the retainer slidably engaging the housing with the stop engaging the catch to limit the motion of the housing relative to the retainer in at least one direction;

a top support secured to the housing;

a lower support secured to the retainer; and the swivel further comprising a first head and a second head rotatably secured to one another, the first head secured to the top support and the second head secured to the lower support;

the support line being secured to the top support and the ride vehicle secured to the lower support.

5. The apparatus of claim 1, further comprising:

a second support line having a first end and a second end, the support structure secured to the second support line proximate the first end of the second support line, the vehicle secured to the second support line proximate the second end of the second support line;

a plurality of cross lines secured between the first support line and the second support line, the cross lines being spaced apart along the length of the first and second support lines, the cross lines extending substantially diagonally relative to the support lines.

6. The apparatus of claim 5, further comprising additional cross lines, the additional cross lines secured to the first support line and to the second support line, the additional cross lines spaced apart along the length of the first and second support lines, the additional cross lines extending substantially diagonally relative to the support lines, the additional cross lines extending crosswise of the first cross lines.

7. The apparatus of claim 6, wherein the first and second support lines and the first and additional cross lines comprise metal cables.

8. The apparatus of claim 1, wherein the assist mechanism is secured proximate the retraction support, the assist mechanism selectively engaging the ride vehicle to assist the retracting mechanism in upwardly raising the vehicle.

9. The apparatus of claim 8, wherein the assist mechanism comprises a counter weight suspended from the retraction support.

10. The apparatus of claim 8, wherein the assist mechanism comprises an assisting cable secured to the counter weight and selectively securable with the ride vehicle.

11. The apparatus of claim 1, wherein the retracting mechanism comprises a retraction line and a winch, the retraction line selectively secured to the ride vehicle, the winch engagable with the retraction line effective to draw the retraction line toward the winch.

12. The apparatus of claim 1, further comprising a damper engaging the retracting mechanism to resist motion of the ride vehicle when the retracting mechanism is engaged with the ride vehicle.

13. The apparatus of claim 12, wherein the damper comprises an assist mechanism secured proximate the retraction support, the assist mechanism selectively engaging the ride vehicle to assist the retracting mechanism in upwardly raising the vehicle.

14. The apparatus of claim 12, wherein the damper comprises a fluid filled tube surrounding a counter weight.

15. The apparatus of claim 12, wherein the damper comprises a clutch engaging the retraction line and resisting motion of the retraction line therethrough.

16. The apparatus of claim 15, wherein the clutch further comprises a biasing spring tending to draw the retraction line into the clutch.

17. The apparatus of claim 16, wherein the clutch is chosen from the group consisting of an electric clutch, a hydraulic clutch, a pneumatic clutch, and a mechanical clutch.

18. An amusement ride comprising:

at least one support extending upward from a support surface;

a vehicle for supporting a load;

a first support line connected between the support and the vehicle to suspend the vehicle and having first longitudinal and lateral directions with respect thereto;

a second support line extending between the support and the vehicle to suspend the vehicle and having second longitudinal and lateral directions with respect thereto; and a first cross-line extending diagonally between the first support line and the second support line at angles with respect thereto selected to substantially reduce motion of the first support line in the first longitudinal direction in the event of failure of the first support line.

19. The apparatus of claim 18, further comprising a second cross-line extending diagonally between the second support line and the first support line at angles with respect thereto selected to substantially reduce motion of the second support line in the second longitudinal in the event of failure of the second support line.

20. The apparatus of claim 19, wherein the first and second cross-lines are substantially unloaded except in the event of failure of at least one of the first and second support lines.

21. The apparatus of claim 18, wherein the first cross-line is directed at angles substantially less than 90 degrees with respect to the first and second support lines.

22. The apparatus of claim 18, wherein the first cross-line is directed at angles less than 75 degrees with respect to the first and second support lines.

23. The apparatus of claim 18, wherein the first cross-line is directed at angles less than 50 degrees with respect to the first and second support lines.

24. The apparatus of claim 18, wherein the first cross-line is directed at angles less than 30 degrees with respect to the first and second support lines.

25. The apparatus of claim 18, wherein the first cross-line is directed at angles less than 10 degrees with respect to the first and second support lines.

26. The apparatus of claim 18, wherein the first cross-line is directed at angles selected to reduce displacement of the first support line in the first longitudinal direction in an amount less than 90 percent of the distance between the first support line and the second support line proximate the first cross-line in the event of failure of the first support line.

27. The apparatus of claim 18, wherein the first cross-line is directed at angles selected to reduce displacement of the first support line in the first longitudinal direction in an amount less than 70 percent of the distance between the first support line and the support second line proximate the first cross-line in the event of failure of the first support line.

28. The apparatus of claim 18, wherein the first cross-line is directed at angles selected to reduce displacement of the first support line in the first longitudinal direction in an amount less than 50 percent of the distance between the first support line and the second support line proximate the first cross-line in the event of failure of the first support line.

29. The apparatus of claim 18, wherein the first cross-line is directed at angles selected to reduce displacement of the first support line in the first longitudinal direction in an amount less than 30 percent of the distance between the first support line and the second support line proximate the first cross-line in the event of failure of the first support line.

30. The apparatus of claim 18, wherein the first cross-line is directed at angles selected to reduce displacement of the first support line in the first longitudinal direction in an amount less than 10 percent of the distance between the first support line and the second support line proximate the first cross-line in the event of failure of the first support line.

31. A load transport comprising:

at least one support extending upward from a support surface;

a vehicle for supporting a load;

a first support line connected between the support and the vehicle to suspend the vehicle and having first longitudinal and lateral directions with respect thereto;

a second support line extending between the support and the vehicle to suspend the vehicle and having second longitudinal and lateral directions with respect thereto; and a first cross-line extending diagonally between the first support line and the second support line at angles with respect thereto selected to substantially reduce motion of the first support line in the first longitudinal direction in the event of failure of the first support line;

a fail-safe member securing the vehicle to the support line proximate the second end of the support line;

a retraction support extending upward from the support surface;

a retracting mechanism secured proximate the retraction support and selectively engagable with the vehicle to draw the vehicle upwardly from the support surface; and a release mechanism selectively securing the vehicle to the retracting mechanism.

32. The load support of claim 31, further comprising an assist mechanism secured proximate the retraction support, the assist mechanism selectively engaging the ride vehicle to assist the retracting mechanism in upwardly raising the vehicle.

33. The apparatus of claim 31, further comprising a damper engaging the retracting mechanism to resist motion of the ride vehicle when the retracting mechanism is engaged with the ride vehicle.

* * * * *